US006796312B2

(12) United States Patent
Eichel

(10) Patent No.: US 6,796,312 B2
(45) Date of Patent: Sep. 28, 2004

(54) PROCESS AND APPARATUS FOR THE REMOVAL OF TOXIC COMPONENTS OF TOBACCO SMOKE AND THE STANDARDIZATION OF THE HEALTH HAZARDS RELATED TO THOSE COMPONENTS

(76) Inventor: Bertram Eichel, 30 Ashmont Dr., Framingham, MA (US) 01701

( * ) Notice: Subject to any disclaimer, the term of this patent is extended or adjusted under 35 U.S.C. 154(b) by 0 days.

(21) Appl. No.: 09/943,144

(22) Filed: Aug. 30, 2001

(65) Prior Publication Data

US 2003/0140933 A1 Jul. 31, 2003

(51) Int. Cl.[7] ..... A24B 15/18

(52) U.S. Cl. ..... 131/334; 131/332; 131/207; 131/202; 131/331

(58) Field of Search ..... 131/202, 200, 131/207, 331, 332, 334, 341, 342, 344, 345

(56) References Cited

U.S. PATENT DOCUMENTS

| | | | | |
|---|---|---|---|---|
| 2,815,760 A | * | 12/1957 | Schreus et al. | 131/208 |
| 3,280,823 A | * | 10/1966 | Bavley et al. | 131/10 |
| 3,459,194 A | * | 8/1969 | Eichel | 131/10 |
| 4,024,237 A | | 5/1977 | Eichel et al. | 424/49 |
| 4,700,723 A | | 10/1987 | Yoshikawa et al. | 131/334 |
| 5,746,231 A | | 5/1998 | Lesser et al. | 131/334 |

OTHER PUBLICATIONS

Bertram, E. and Shahrik, Arto H. "*Tobacco Smoke Toxicity: Loss of Human Oral Leukocyte Function and Fluid–Cell Metabolism*". Science, Dec. 12, 1969, vol. 166, pp. 1424–1428.

Warner, Kenneth E., et al. "*The Conference on Tobacco Dependence: Innovative Regulatory Approaches to Reduce Death and Disease*". Food and Drug Law Journal. vol. 53, Supplement (1998), 147 Pages.

The NCI Tobacco Research Implementation Group. "*Tobacco Research Implementation Plan: Priorities for Tobacco Research Beyond the Year 2000*", 49 Pages.

* cited by examiner

*Primary Examiner*—Dionne A. Walls
(74) *Attorney, Agent, or Firm*—John C. Serio; Mark S. Leonardo; Brown Rudnick Berlack Israels LLP

(57) ABSTRACT

The oral cavity is a source of sensitive biomarkers that allow the development of novel tobacco filters to reverse and eliminate acute adverse effects of tobacco smoke. Useful biomarkers are ubiquitous functional leukocytes and associated essential biochemical mechanisms, including metabolic pathways and specific enzymes, such as myeloperoxidase contained in fluid-cell lavages obtained from the human mouth. These biomarkers derived from the human mouth and sputum from the human respiratory system can be used to evaluate long-term chronic effects of tobacco smoke. A tobacco filter comprising strongly basic anion exchange resins and strongly acidic cation exchange resins with or without activated carbon, is used to detect, reduce and eliminate toxic substances from tobacco smoke while retaining taste and aroma. The novel filter in conjunction with biomarkers allow the establishment of performance standards that permit the direct visualization and measurement of acute adverse reactions caused by tobacco smoke. The measurement of these adverse effects allow a human health hazard reduction scale to be created to inform smokers of the relative "safety" of any smoking product.

27 Claims, 9 Drawing Sheets

* REDUCED NICOTINAMIDE - ADENINE DINUCLEOTIDE

* REDUCED NICOTINAMIDE - ADENINE DINUCLEOTIDE

** STABLE STATE

† ACUTE BACTERIAL EXACERBATION

* REDUCED NICOTINAMIDE - ADENINE DINUCLEOTIDE

** STABLE STATE

† ACUTE BACTERIAL EXACERBATION

* HYDROGEN PEROXIDE

** STABLE STATE

† ACUTE BACTERIAL INFECTION

* REDUCED NICOTINAMIDE - ADENINE DINUCLEOTIDE

** STABLE STATE

† ACUTE BACTERIAL EXACERBATION

PROCESS AND APPARATUS FOR THE REMOVAL OF TOXIC COMPONENTS OF TOBACCO SMOKE AND THE STANDARDIZATION OF THE HEALTH HAZARDS RELATED TO THOSE COMPONENTS

FIELD OF INVENTION

The present disclosure relates to novel tobacco filters and their use in determining the relative "safety" of tobacco products. The tobacco filters of the present disclosure eliminate toxic compounds found in the gas-vapor phase of tobacco smoke and reduce tar and nicotine found in the particulate phase of tobacco smoke.

BACKGROUND OF THE INVENTION

The personal and societal habit of tobacco smoking has existed for centuries, but the severity of its potential detrimental health effects has only undergone serious scrutiny in the last several decades. It is now commonly accepted that tobacco smoke contains mutagenic and carcinogenic compounds that relate to serious adverse health consequences. The presence of these compounds in tobacco smoke creates a significant cost to society by increasing health costs and causing premature mortality (currently estimated to be some 3,000,000 people per annum worldwide, 400,000 to 470,000 people per annum in the United States). The adverse affects of tobacco smoke are linked to major pathological conditions such as: cancer, cardiovascular disease, stroke, chronic obstructive lung diseases (including chronic bronchitis, asthma and emphysema), periodontal disease, etc. While recent efforts at educating consumers about the harmful effects of tobacco smoke and smoking prevention programs have been helpful, people continue to smoke despite these educational efforts to the contrary. Attempts to reduce the harmful effects of tobacco smoke have included positioning filters of varying compositions within tobacco products. Current filters that are available, such as those made from cellulose acetate have only been moderately successful at decreasing the particulate portion of tobacco smoke that contains tar and nicotine. While reduction of tar mid nicotine are believed to be helpful, conventional filters have been unsuccessful at effectively removing components within the gas-vapor portion of tobacco smoke containing the most toxic components, with the exception of activated carbon filters which are known to remove small amounts of cyanide and carbon monoxide. Additionally, the relative health benefits of removing particulate matter and toxic components in the gas-vapor phase from tobacco smoke is not well understood and its effect on the health of smokers is without standards There is, therefore, a need for an improved tobacco filter that substantially removes the harmful components within the gas-vapor phase. There is a need for a filter that while removing the harmful components of tobacco smoke allows passage of those portions of tobacco smoke, which are taste and aroma acceptable by smokers, but not harmful to smokers and non-smokers. Further there is a need for a standard by which the relative "safety" of a tobacco product can be assessed.

SUMMARY OF THE INVENTION

The oral cavity is the primary portal of entry for tobacco smoke. This fact leads to the conclusion that the maximum impact of tobacco is best observed by direct study of tobacco's effects on biological and biochemical mechanisms within the oral cavity. When humans smoke a single conventional over-the-counter unfiltered or filtered cigarette through a Cambridge Filter interposed between the cigarette and the smoker's lips, the filter separates and removes the particulate phase from the gas-vapor phase of tobacco smoke, permitting only the gas-vapor phase to enter the mouth. The action of the retained gas-vapor phase residue on the in situ exposed inflammatory cells and biochemical parameters induces the same adverse effects as obtained for whole tobacco smoke.

Suitable filter assist devices according to this disclosure containing anion and cation exchange resins capture these toxic components contained within the gas-vapor phase of tobacco smoke and reverse these adverse effects.

Strongly acidic cation exchange resins and the bicarbonate form of strongly basic anion exchange resins alone or in combination approximately one inch to one and one-half inch long are effective at removing toxic components found in the gas-vapor phase and still allow the resulting smoke to be acceptable to the smoker. Combinations of these ion exchange resins in equal parts forming lengths of approximately one to one and one-half inch long are found to be effective and also allow the tobacco smoke to be taste and aroma acceptable. Strongly basic anion exchange resins of equal length are also effective, but because of some ammonia release are probably taste and aroma unacceptable. Activated carbon filters of equal length are also effective, but the resultant smoke is taste and aroma unacceptable. Combinations of a strongly acidic cation exchange resin and/or the bicarbonate form of a strongly basic anion exchange resin, and activated carbon are equally effective and taste and aroma acceptable. The latter three components in combination can be reduced to approximately three quarters (¾) inch length and remain effective and taste and aroma acceptable.

When cigarettes or other tobacco products are smoked the smoke first enters the mouth, is inhaled-past the pharynx, larynx, into the trachea, bronchi, and bronchioles and in many instances, deep into the alveolar tissue of the lungs. Many smokers of cigars and pipes find cigar smoke and pipe tobacco smoke too strong and tend not to inhale deeply or not at all. In these individuals, the mouth and pharynx are most directly exposed to the tobacco smoke. Cigarette, cigar and pipe tobacco smokers exhale each product's smoke either primarily through and from the mouth or secondarily through and from the nose into the environment. Therefore the oral cavity serves as the ideal open capture system and trap for tobacco smoke to enable the direct detailed study of acute adverse biological effects of toxic substances in smoke.

Following direct exposure of the mouth to the impact of whole tobacco smoke (puffing one conventional over the-counter unfiltered or filtered cigarette without limiting the number of puffs, without inhaling, while exhaling from the mouth and occasionally from the nose), the retained residue of whole tobacco smoke is captured in the mouth. The oral retained residue of whole tobacco smoke can be recovered in lavages of the oral cavity yielding fluid-cell harvests that show:

1) Inhibition of the function of the essential first line of defense cell of the host immune system, the polymorphonuclear neutrophil;
2) Inhibition of the aerobic endogenous, aerobic (d) glucose dependent and anaerobic (d) glucose dependent metabolism of oral fluid-cell harvests containing these cells; and 3) Inhibition of myeloperoxidase, the essential bacterial kill and toxin-detoxifying enzyme of the neutrophil and other enzyme systems contained in oral fluid-cell harvests.

The oral cavity provides sensitive and significant in vivo open bioassay and biochemical assay systems as biomarkers for detecting, tracing, measuring and eliminating acute effects of undesirable substances present in the gas-vapor phase of tobacco smoke.

Components derived from the human oral cavity offer the opportunity to assess essential, sensitive biological and biochemical parameters as biomarkers for the direct study of tobacco smoke. These components can be used to asses the following: 1) to evaluate the potential of real deleterious effects of tobacco smoke; 2) to determine which substances in tobacco smoke are toxic in situ; 3) to determine the relative toxicity of different substances in tobacco smoke; and 4) to develop reliable new tobacco smoking products (for example, incorporating new tobacco filter assist devices) that are capable of reversing or eliminating the adverse effects of over-the-counter smoking products. Filtered tobacco smoke puffed through filter devices as propounded herein provide smoke purged of major toxic substances contained in its gas-vapor phase and substantial reductions of its tar and nicotine that result in a "safer" smoke as the purported goal by the Institute of Medicine and the Food and Drug Administration. The removal of these harmful components should lead to substantial reduction of tobacco smoke induced health risk and minimize health hazards over the long term.

Based on the biomarker evidence and criteria in toto enumerated above, this disclosure also includes a human health hazard reduction ("HHR") scale to enable its adoption as a standard by interested parties. These parties include but are not limited to the Tobacco Industry, Federal Trade Commission, Food and Drug Administration, the United States Public Health Service, etc. and their equivalent entities in other countries to inform smokers and the public of the relative "safety" of any smoking product.

Based on other biomarker evidence from the study of sputum of a small number of smoker and ex-smoker chronic bronchitics, a useful model has been developed which differentiates, this population of chronic bronchitics into two separate groups, a chronic bronchitic smoker cohort and a chronic bronchitic ex-smoker cohort. Long-term studies of humans suffering from this chronic obstructive pulmonary disease specifically employing reduced toxic substances smoking products proposed herein opposed to conventional smoking products can provide useful information in regard to health status by comparing cohort groups for each type of smoker product to ex-smoker and non-smoker cohort groups.

BRIEF DESCRIPTION OF THE DRAWINGS

The foregoing and other features and advantages of the present invention will be more fully understood from the following detailed description of illustrative embodiments, taken in conjunction with the accompanying drawings in which.

DETAILED DESCRIPTION OF EXEMPLARY EMBODIMENTS

Figure 1:
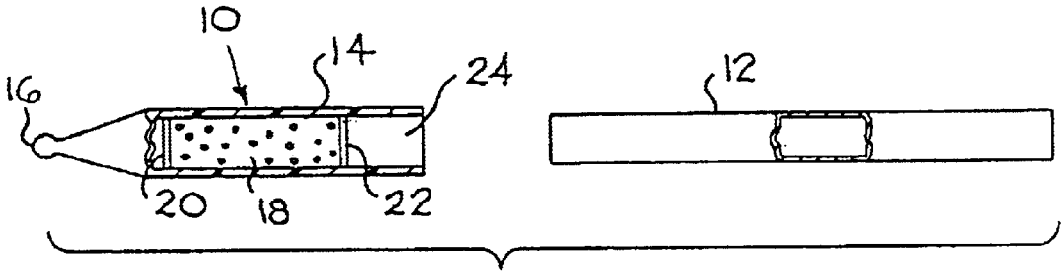
FIG. 1 is a side view of a generalized disposable untized filter assist device holder of this invention for use when smoking cigarettes or cigars.

The disclosed exemplary embodiments and examples of use and operation are discussed in terms of an improved tobacco filter and the use of this improved filter and biomarkers to assess the effectiveness of the filter, and more particularly, in terms of developing a standardized rating system utilizing the filter devices to assess the relative safety of tobacco smoke from conventional tobacco products. The inventive tobacco filter is useful in the removal of toxic compounds from tobacco smoke and is employable in the development of rating systems to allow consumers of tobacco products the ability of assessing the relative safety of the tobacco product used.

The present disclosure is directed towards an improved tobacco filter that removes toxic components of tobacco smoke within the gas-vapor phase and sensitive bioassays and biochemical assays that can be adapted as an essential screen and biomarkers for the study of ubiquitous human oral leukocytes. The study of these leukocytes, most specifically the polymorphonuclear neutrophil, can be used for the detection, measurement, reduction and elimination of toxic substances in tobacco smoke.

Tobacco smoke can be compartmentalized into two major categories primary tobacco smoke and secondary tobacco smoke.

Primary tobacco smoke consists of two types: direct mainstream smoke, which is that portion which the smoker inhales into the mouth and respiratory system and sometimes swallows and secondary tobacco smoke is the side stream smoke from the smoldering, burning end of the smoking product emitted into the environment when the smoker is not puffing.

Passive smoking by non-smokers and smokers of secondary smoke (also called second hand smoke) consists of two types; first is the smoker altered direct main-stream smoke that the smoker exhales; and second, the primary side-stream smoke from the burning end of the tobacco bed.

Using the aforementioned assay criteria, an object of this invention is directed towards tobacco filter assist devices that purge toxic substances and substantially reduce tar and nicotine from tobacco smoke. The removal of toxic substances from primary smoke results in reduced health risk to the smoker; and consequently the purged secondary smoke exhaled into the environment leads to reduced air contaminants inhaled by smokers and non-smokers, resulting in reduced health risk to each group. Only the primary direct side-stream smoke emitted into the environment from the burning end of the tobacco is not affected directly by these devices. However, it is clear that effects of passive smoking from secondary smoke emitted into the environment of enclosed places (such as: rooms, buildings, vehicles, etc.) can be similarly purged of toxic substances reducing materially the adverse effects, by the kinds of the effective filter device systems proposed herein and by adapting the principals of using charge resins in combination with activated charcoal in air conditioning and other air ventilating systems Another object of this disclosure is to establish a standard by using the fluid-cell harvests derived from the oral cavities of human smokers, ex-smokers and non-smokers and the sensitive bioassay and biochemical assays derived from these fluid-cell harvests as biomarkers and performance standards for detecting, measuring and eliminating acute toxicity effects of tobacco smoke.

Another object of this disclosure is to provide novel tobacco filter assist devices comprising essentially a functional bed of an ion exchange resin in any physical form-beads, granules, fibers, yarn, etc., or combination bed of functional ion exchange resins in any physical form, or combined functional bed of an ion exchange resin in any physical form and activated carbon, or combined functional bed of ion exchange resins in any physical form and activated carbon and/or other materials and substances known or unknown in the art that achieve the first three objects.

Another object is to provide novel tobacco filter assist devices which essentially purge tobacco smoke of the irritating and toxic substances contained in the gas-vapor phase, while substantially reducing tar and nicotine, without compromising the taste and aroma of the tobacco smoke.

Another object of this disclosure is to create a systematic health hazard reduction ("HHR") scale using the aforementioned and other biological and biochemical assays, as biomarkers and performance standards to measure the extent of toxic substance reduction or removal from the gas-vapor phase of tobacco smoke by these novel filter assist devices or any other known or as yet unforeseen or unknown products or methods. A similar HHR scale can be applied to the reduction of the particulate phase for tar ant its contained components and nicotine reduction. Such standards are of value in the labeling of smoking products to inform the smoking and non-smoking public of the relative safety of any smoking product.

In the preferred embodiment, the active components of the filter assist devices employed as a trap for undesirable substances of tobacco smoke consist of either:

1) a strongly basic anion exchange resin; or
2) the bicarbonate form of a strongly basic anion exchange resin; or
3) a strongly acidic cation exchange resin; or
4) a combination of (1) and (3) or (2) and (3); or
5) a combination of either of the ion exchange resins of (1), (2) or (3) plus activated carbon; or
6) a combination of the two ion exchange resins in (2) and (3) plus activated carbon.

Figure 2:
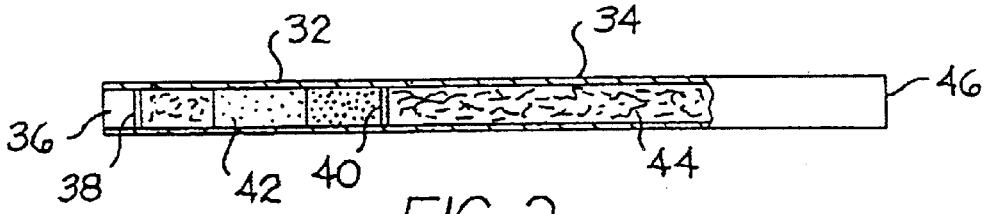
FIG. 2 is a side view of a generalized novel filter assist device unitized, joined or tied to a cigarette or cigar.
Figure 3A:
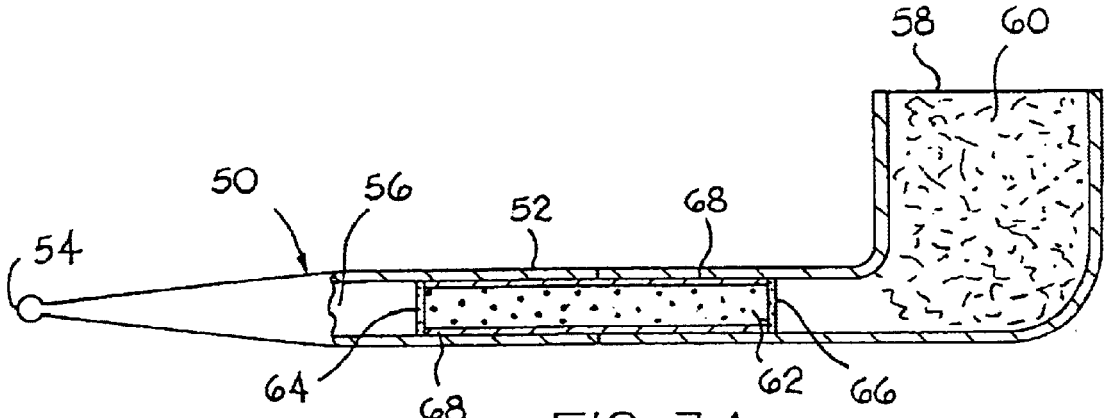
FIG. 3A and FIG. 3B show a side view of a generalized novel insert filter assist device cartridge for a smoking pipe or cigarette or cigar holder.
Figure 4A:
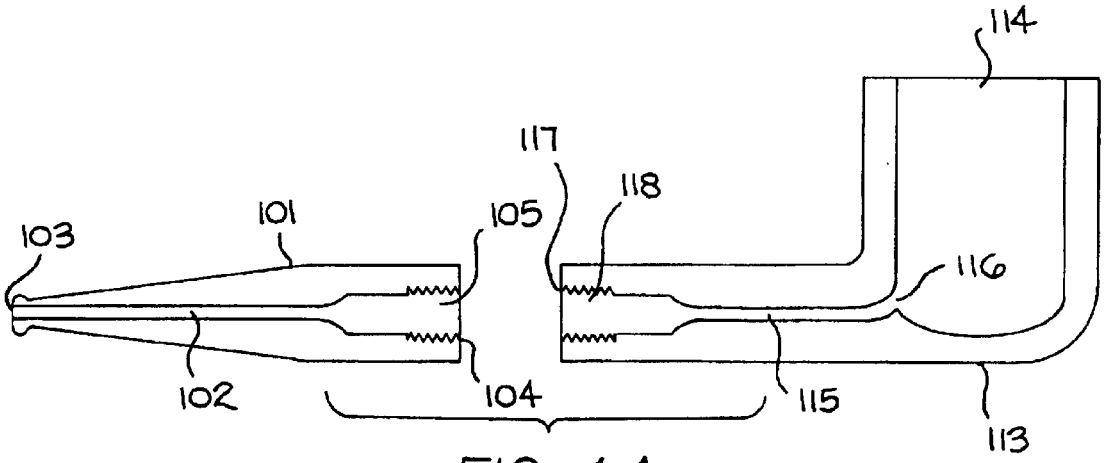
FIG. 4 is a side view of a novel filter assist device having a threaded feature that can be used in a two part pipe.
Figure 4B:
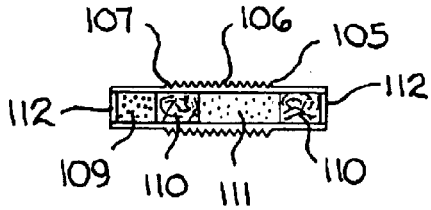

The filter bed or trap for cigarettes, cigars or pipes should be approximately three quarters (¾) of an inch in length to approximately one and one half (1½) inches, the diameter of the bed being on the order of approximately less than one quarter (¼) inch or greater In the case of a unitized filter cigarette (FIG. 2), the filter should be approximately the same diameter as the cigarette. For a unitized filter cigar, the diameter of the filter can be the same as that for a cigarette. In the case of a unitized disposable filter cartridge and holder, as shown in FIG. 1, the filter should be approximately the same diameter as the tobacco bed plus its wrap for a cigarette. For a unitized disposable filter cartridge and holder for a cigar, the diameter of the filter can be the same as that for a cigarette. In the case of a disposable insert cartridge and customized one-piece or two-piece reuse holders as shown in FIGS. 3A and 4, the diameter of the insert filter charge plus its wall member should be approximately the same as the diameter of the tobacco bed plus its wrap for a cigarette or for the inner diameter of the stem of a two piece pipe. In the case of pipes only a disposable insert cartridge is envisioned, since it is unlikely that disposable pipes would be cost effective. For cigar holders, the criteria for diameter for disposable insert filter cartridges are the same as shown in FIGS. 1 and 2. The depth of these disposable insert filter systems should be equated to the lengths of the tobacco devices.

It is contemplated within this disclosure that these filter assist devices preferably, but not necessarily, further include any of the previously known means for removing tars and nicotine contained in the particulate fraction of tobacco smoke.

As mentioned above, the present disclosure is directed toward a filter for tobacco smoke to prevent and/or reduce the adverse effects upon human oral leukocytes or other like host cells of the immune system, their metabolism and essential enzymes.

In earlier work, Eichel and Shahrik (1969), and consistently thereafter in accordance with the present disclosure, observed that in properly prepared oral fluid-cell harvests obtained from humans, most peripheral oral leukocytes are intact, alive and functional. In typical oral fluid-cell harvests, many of the leukocytes (free or contained in clusters) locomote, vigorously forming pseudopodia, while demonstrating protoplasmic flow, cell stretching or extension and movement of cell organelles internally. Frequently, these leukocytes actively phagocytize large rod, chain, filamentous or other microorganisms.

Employing the oral cavity as a smoke trap, and having subjects take between six (6) to thirty (30) puffs without inhaling, over 2 to 3 minute periods; from conventional over-the-counter cigarettes, filtered or unfiltered, lavages of the mouth after smoking yield oral fluid-cell harvests which contain free or clustered leukocytes. These leukocytes appear on the brink of locomotion and possible phagocytosis, but remain incapable of overcoming the locomotion and phagocytosis inhibiting effects of toxic substances contained within tobacco smoke. The smoke obtained from puffing a single cigarette without inhaling appreciably inhibits the metabolism of oral fluid-cell harvests. For example, in excess of fifty (50) percent inhibition of the aerobic endogenous metabolism and aerobic (d) glucose dependent metabolism, as measured by diminished oxygen consumption, is observed. In excess of fifty (50) percent inhibition of the anaerobic (d) glucose metabolism, as measured by diminished carbon dioxide evolution also is observed.

The same adverse effects upon oral leukocytes occur when a cigarette is smoked through a "Cambridge CM113A" (Cambridge Filter Corp.) filter which holds back or separates out all of the visible particulate smoke. In this manner, more than ninety-nine (99) percent of the particulate matter (tars and nicotine) is removed excluding virtually all acceptable taste and aroma associated with the tobacco smoke. Essentially, only the unpleasant invisible gas-vapor phase of the smoke passes through this filter into the human mouth, thereby establishing that the probable harmful substances in tobacco smoke which so adversely affect the functional state of the oral leukocytes are present in the invisible gas-vapor phase.

It further is found, in accordance with this disclosure, that the aforementioned adverse effects of smoking upon oral leukocytes may be obviated by utilizing a tobacco filter comprising essentially a material such as an ion exchange resin, e.g., a strongly basic anion exchange resin such as "Amberlite IRA-900" (trade name of Rohm & Haas Co. for a highly porous, type I, strong base, quaternary ammonium anion exchange resin possessing an extremely high fixed porosity); "Dowex" resins such as Dowex 1, 2, 11 or 21K (trade name of Dow Chemical Co., for strongly basic anion resins comprising a hydrocarbon network consisting essentially of a copolymer of styrene and divinylbenzene and incorporating a quaternary ammonium type of structure, Dowex 1, 11, and 21K being type 1 resins, the four substituents on the N atom being a polymeric benzyl and 3 methyl groups, Dowex 2 being a type II resin in which one of the methyl groups is replaced by an ethanol group); modified strongly basic anion exchange resins such as that obtained by converting "Amberlite IRA-401" (Rohm &Haas Co.) to the corresponding bicarbonate, etc.; or strongly acidic cation exchange resins such as Dowex 50W (trade name of Dow Chemical Co.) consisting essentially of a copolymer of styrene-divinylbenzene incorporating nuclear sulfonic acid $(RSO^3)H$, etc. Strongly basic anion exchange resins, the bicarbonate form of strongly basic anion exchange resins, and strongly acidic cation exchange resins were found most efficient in reversing the aforementioned adverse effects of tobacco smoke.

In addition, similar findings occurred with filter beds consisting of combinations of strongly basic anion exchange resins and strongly acidic cation exchange resins. Equal amounts of both resins in combination with activated carbon provide effective filter beds. The minimum filter length is approximately three quarters of an inch long consisting of approximately one quarter (¼) inch length of a strongly acidic cation exchange resin, plus approximately one quarter (¼) inch length of the bicarbonate form of a strongly basic anion exchange resin, plus approximately one quarter (¼) inch length of activated carbon.

The novel smoking filters of this disclosure may be employed in the various manners in which tobacco filters have heretofore been employed. They may, for example, be employed in a disposable holder adopted for use with cigarettes and/or cigars. FIG. 1 illustrates the use of the novel filter in cigarette holders that can be used for one or more cigarettes.

As shown in FIG. 1, a holder 10 of generally known construction is provided for use with a cigarette 12. The holder 10 comprises a hollow generally cylindrical element defined by a wall member 14 of suitable strength and rigidity, e.g., plastic or other similar material, tapering into a mouthpiece 16 of known construction for placement between the lips and having an opening for permitting egress of smoke from the holder into the mouth. FIG. 1 further shows a filter bed 18 confined between an opposed porous members 20 and 22 at some point between the mouthpiece 16 and an opposed end 24. The porous members 20 and 22 may comprise any porous material (e.g., paper, plastic, porous methyl-cellulose or various packed fibers) sufficient to retain the filter bed, or they may comprise a perforated non-porous material. The internal circumference of the wall member 14 is adapted for frictional engagement of the external circumference of the cigarette when inserted in the hollow portion of holder 10 at end 24 in juxtaposition with porous member 22. The distance between member 22 and end 24 is a sufficient length to engage cigarette 12 securely. When employed in a holder for use with a typical so-called "regular" or "greater size" cigarette, e.g., a cigarette on the order of 70 mm shorter or greater in length, the filter bed defined by porous members 20 and 22 is for optimum results approximately three quarters (¾) inch in length to the order of 1.5 inches, the diameter or thickness being approximately that of the tobacco bed in the cigarette, e.g., on the order of approximately a quarter of an inch. However, it is contemplated within the scope of the disclosure to employ filter beds of shorter length and varying thickness.

While for purposes of illustration, holder 10 is shown as a cigarette holder, by varying the internal circumference defined by wall member 14, the holder may be employed for cigars. It is contemplated that means (not shown) may be provided at end 24 for varying the circumference and/or for engaging either a cigarette or a cigar so that a single holder may be employed for both.

When employed for use with cigars on the order of six (6) or seven (7) inches in length, the filter bed is preferably on the order of one (1) to one and a half (1½) inches in length and the diameter or thickness being on the order of a quarter (¼) of an inch or greater.

Figure 3B:
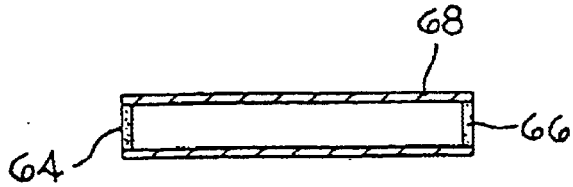

While for purposes of illustration, the filter bed is shown confined within the area defined by wall member 14, it may be contained initially in a cartridge or the like adapted for insertion within holder 10 in the manner shown in FIGS. 3A and 3B. This latter construction allows for a variety of holders and permits ready substitution of filters when desired.

The novel filter of this disclosure also may be incorporated in combination with cigarettes and/or cigars. In an alternative embodiment a unitized filter device cigarette in accordance with this disclosure is shown in FIG. 2. A cigarette 30 is shown having a filter incorporated into the cigarette that comprises wall members 32 and 34 defining a cigarette of typically cylindrical configuration. The wall members 32 and 34 may be of the same material, paper or the like, or may he different. They may consist of a single material extending from one end to the other or one may overlap the other and be adhered thereto in any of the known manners. Wall member 32 and porous members 38 and 40 define a filter bed 42 at one end of the cigarette. Members 38 and 40 may be the same as the previously described members 20 and 22 of the holder of FIG. 1. Member 38 is shown recessed from end 36 in a manner typical to so-called recessed filters. Tobacco 44 is shown confined between wall member 34 in the space defined by porous member 40 and end 46.

In a filter cigarette of the foregoing construction, the ratio of the length of the filter bed, e.g., as defined by members 38 and 40, to the length of the tobacco bed, e.g., as defined by member 40 and end 46, is preferably on the order of 1:2 to 1:4. Thus, for example, where the length of tobacco bed is on the order of three (3) inches, the length of the filter bed is preferably on the order of at least three quarters (¾) to 1.5 inches, although greater and lesser ratios and lengths are also contemplated within the scope of this disclosure.

Filter cigars of the general configuration shown in FIG. 2 are also contemplated. In a filter cigar, the ratio of the length of the filter bed to the length of the tobacco bed is preferably on the order of approximately 0.75:7 to 1.5:7. Filter cigarettes and/or cigars of the foregoing description may, if desired, include a "built in" mouthpiece to facilitate engagement between the lips.

The novel filter of this disclosure may also he employed as a cartridge insert or the like which for example, may be inserted in smoking pipe stems, as shown in FIGS. 3A and 3B. As shown therein, like a two piece cigarette or cigar holder, a two-piece conventional pipe 50 of known material 52 and construction defining a mouthpiece 54, a stem 56 and a bowl 58 for tobacco 60 is shown to contain at some point between the mouthpiece and the bowl, a disposable or refillable cartridge insert or the like comprising an effective filter 62 confined within an area defined by outer wall member 68 or a suitable material, e.g., a thin heat polymerized plastic material, and porous end walls 64 and 66. The outer diameter of wall member 68 is slightly smaller than the internal diameter of pipe wall member 52 within the stem position of the pipe, but so designed to preclude any material passage of smoke between the respective wall members, i.e., so that all smoke must pass through the filter bed to mouthpiece 54. In this aspect of the disclosure, the pipe may be of one-piece construction, although typically such pipes do not provide ready access for placement, cleaning and replacement of the filter cartridge, if needed. Here the general construction of the pipe accordingly must be at least a two piece type 50. The essence of this aspect of the embodiment being the combination of a novel disposable filter cartridge insert of this invention for a cigarette holder, or cigar holder, or smoking pipe of known configuration, e.g., as illustrated in FIGS. 3A and 3B.

In an alternative embodiment a two piece pipe is shown in FIG. 4. This embodiment consists of first portion having a mouthpiece 101 having a channel 102 throughout. This channel 102 has a first end 103 and a second end 104. The second end 104 contains a female threaded channel 105. The female threaded channel 105 is designed to receive a filter assist device 106 having a first male threaded end 107 and a second male threaded end 108. The filter assist device of this embodiment contains approximately one-quarter inch of activated carbon 109 and approximately one-half inch of a bicarbonate form of a strongly basic anion exchange resin 110 and approximately one-half inch of a strongly acidic cation exchange resin 111. The first male end 107 and the second male end 108 have at their distal ends a perforated plastic disc 112. A second portion of the pipe 113 contains a bowl 114 and a channel 115 throughout. The channel 114 has a first end 116 and a second end 117. The first end 116 connects to the bowl 114. The second end 117 contains a female threaded channel 118. The female threaded channel 118 is designed to receive a filter assist device 106 having a male threaded ends 107, 108. The threaded channels 105, 118 engage the filter assist device 106 in a manner that allows the assembly of the first portion 101 with the second portion 113 in conjunction with the filter assist device 106 in a sealable manner.

Figure 5:
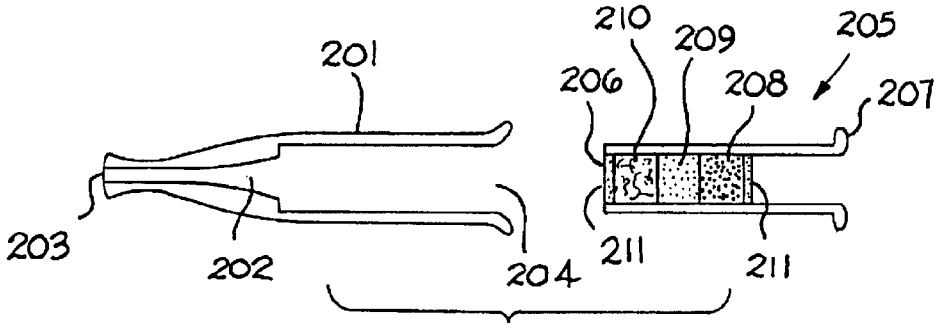
FIG. 5 is a side view of a novel filter assist device having means to engage a cigarette or cigar holder.

In a further alternative embodiment, a cigarette or cigar holder is shown in FIG. 5. This embodiment consists of a mouthpiece 201 having a channel 202 throughout. The channel 202 has a first end 203 and a second end 204. The second end 204 of the channel 202 is enlarged in order to receive a disposable filter assist device 205. The disposable filter assist device 205 has a first end 206 and a second end 207. The filter assist device 205 of this embodiment contains approximately one-quarter inch of activated carbon 208 and approximately one-half inch of a bicarbonate form of a strongly basic anion exchange resin 209 and approximately one-half inch of a strongly acidic cation exchange resin 210. The first end 206 and the second end 207 have at their distal ends a perforated plastic disc 211. The outer circumference of the disposable filter assist device 205 removably inserts into the second end 204 of the channel 202 and is a sealed by friction.

Figure 6:
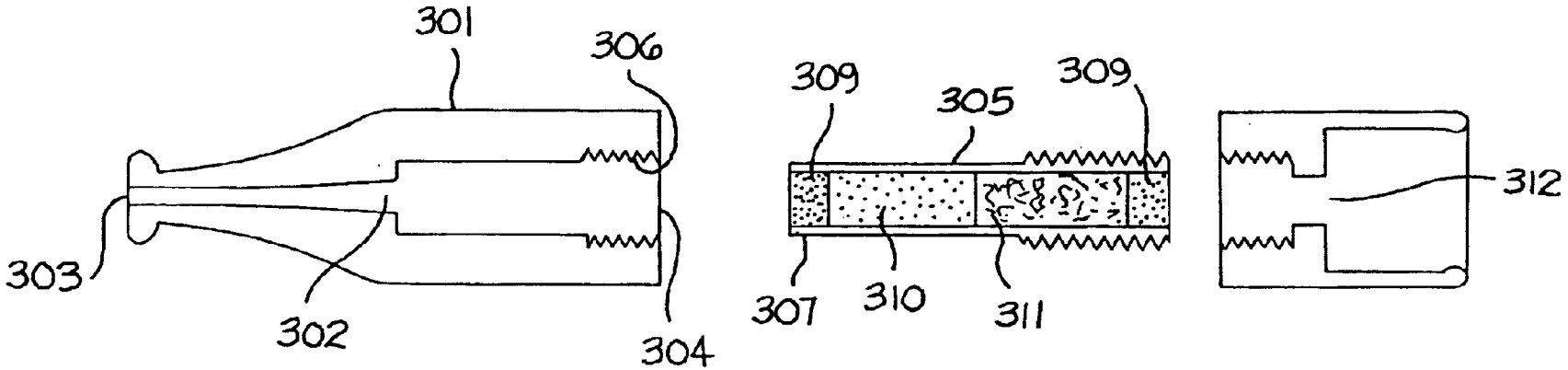
FIG. 6 is a side view of a novel filter assist device having a threaded portion that allows the secure engagement of the filter within a cigarette or cigar holder.

In yet a further alternative embodiment, a cigarette or cigar holder is shown in FIG. 6. This embodiment consists of a mouthpiece 301 having a channel 302 throughout. The channel 302 has a first end 303 and a second end 304. The second end 304 of the channel 302 is enlarged in order to receive a disposable filter assist device 305. The second end of the channel further contains a female threaded portion 306. The disposable filter assist device 305 has a first male end 307 and a second end 308. The filter assist device 305 of this embodiment contains approximately one-quarter inch of activated carbon 309 and approximately one-half inch of a bicarbonate form of a strongly basic anion exchange resin 310 and approximately one-half inch of a strongly acidic cation exchange resin 311. The first male end 307 and the second end 308 have at their distal ends a perforated plastic disc 312. The threaded portion 306 engages the first male end 307 of the filter assist device 305 in a sealable manner.

Illustrative embodiments regarding the methods of making and using the filter assist device of the present disclosure are described in greater detail in the following examples, provided for purposes of further illustration. The following examples are not intended to be construed as limiting the scope of the present disclosure.

EXAMPLE 1

Obtaining Human Oral Fluid-cell Harvests

Human oral fluid-cell harvest yields are obtained by a simple procedure. In the following examples, human subjects introduced into their mouths a piece of chewing paraffin and 5.0 ml. of a cold protective harvesting solution a method as disclosed in U.S. Pat. No. 4,024,237. Each subject chewed for thirty (30) seconds without swallowing and expectorated all fluid into a graduated centrifuge tube.

More than one hundred (100) human subjects were studied in the following manner. Leukocyte, epithelial cell, granular mass and bacteria counts were made on repetitive fluid-cell harvests from apparently healthy male and female subjects, smokers and non-smokers, ranging in age from fifteen (15) to fifty-seven (57) years. In this example the leukocyte data is given for sixteen (16) subjects.

The subjects were sampled at any arbitrary time without eating, drinking, chewing, smoking, brushing the teeth or rinsing the mouth for at least one hour. The yield being designated the zero time oral fluid-cell harvest. To achieve this, a piece of chewing paraffin and 5.0 ml. of harvesting fluid were introduced into the oral cavity. The subject vigorously chewed for thirty (30) seconds and without swallowing, expectorated all fluid into a graduated centrifuge tube. Fluid-cell harvest yields for all subjects ranged between 5.8 ml. and 9.3 ml. indicating a 0.8 ml. to 4.3 ml. of essentially saliva fluid contribution from the mouth. The fluid volume yield for a given subject generally was consistent. Between zero time fluid-cell harvest and each subsequent harvest the subject also was not permitted to eat, drink, smoke, chew, brush the teeth, or rinse the mouth. The subsequent oral fluid-cell harvests were identified in accord with the sequence and time intervals that the samples were taken. For example, the second collection was obtained five (5) minutes after the zero time fluid-cell harvest to yield the five (5) minute fluid-cell harvests. Ten (10) minutes after the second collection, the ten (10) minute fluid-cell harvest was obtained. The time intervals for subsequent collections were extended to yield in sequence, respectively, twenty (20) minutes, forty (40) minute and sixty (60) minute fluid-cell harvests. Sampled in this manner, it was assumed that the ten (10) minute fluid-cell harvest cycled through a five (5) minute fluid-cell harvest plus allowing an additional five (5) minute recovery time to approach the composition of the zero time fluid-cell harvest. In this manner, the sixty (60) minute fluid-cell harvest thus cycled through a recovery period equivalent to that of the five (5), ten (10), twenty (20) and forty (40) minute fluid-cell harvests, respectively, plus permitting an additional twenty (20) minutes toward recovery.

The cell count patterns obtained showed that the forty (40) minute oral fluid-cell harvests most frequently yielded the highest leukocyte counts. Where this did not occur, either the sixty (60) minute harvests yielded the largest number of leukocytes or the forty (40) minute and sixty (60) minute samples yielded near equal high leukocyte quantities. Total leukocyte counts contained in such forty (40) minute and sixty (60) minute oral fluid-cell harvests for the above group of subjects varied from 3,200,000 to 41,800,000. Leukocyte counts/ml. of oral fluid-cell contribution recovered from the mouth for the forty (40) minute and sixty (60) minute harvests ranged from 1,500,000 to 20,900,000. Table I gives the equilibrium and recovery counts of leukocytes per total volume and the total volume of the standardized oral-fluid contributions in the lavages for each subject in this group.

TABLE I

Equilibrium and Recovery Counts of Leucocytes per Total Volume of Standardized Human Oral Lavages

| TIME IN MINUTES | | | | | | | | | | | | | | |
|---|---|---|---|---|---|---|---|---|---|---|---|---|---|---|
| Equilibrium | | Recovery | | | | | | | | | | | | |
| 0 min | | 5 min | | 10 min | | 20 min | | 40 min | | 60 min | | | | |
| Count $\times 10^6$ | Vol. ml. | Count $\times 10^6$ | Vol. ml. | Count $\times 10^6$ | Vol. ml. | Count $\times 10^6$ | Vol. ml. | Count $\times 10^6$ | Vol ml. | Count $\times 10^6$ | Vol ml. | Sex | Age | Subject # |
| 2.2 | 7.0 | 1.0 | 6.5 | 1.8 | 7.6 | 2.5 | 7.5 | 3.7 | 6.5 | 3.5 | 6.9 | F | 20 | 7 |
| 2.9 | 6.1 | 0.7 | 6.0 | 1.7 | 6.9 | 1.8 | 6.5 | 4.1 | 6.8 | 3.2 | 7.2 | F | 21 | 10 |
| 3.6 | 7.2 | 2.4 | 6.6 | 1.2 | 7.4 | 3.5 | 7.3 | 7.4 | 8.2 | 5.4 | 7.5 | F | 19 | 14 |
| 4.4 | 6.2 | 0.8 | 5.9 | 1.6 | 6.4 | 2.9 | 7.4 | 8.0 | 7.6 | 5.2 | 6.2 | M | 20 | 15 |
| 6.5 | 8.0 | 2.0 | 7.8 | 3.5 | 7.8 | 5.3 | 8.0 | 5.8 | 6.7 | 5.0 | 7.3 | F | 28 | 8 |
| 6.5 | 6.4 | 3.3 | 7.0 | 1.6 | 5.9 | 4.5 | 6.2 | 9.7 | 7.7 | 6.7 | 6.4 | F | 18 | 13 |
| 8.0 | 6.4 | 1.6 | 5.8 | 2.6 | 6.3 | 4.5 | 6.2 | 10.4 | 6.8 | 8.8 | 7.0 | F | 15 | 4 |
| 8.7 | 6.2 | 3.5 | 6.0 | 1.2 | 6.4 | 4.6 | 6.0 | 9.2 | 6.1 | 10.0 | 7.0 | M | 31 | 16 |
| 13.7 | 7.9 | 4.0 | 6.7 | 6.4 | 6.7 | 7.8 | 6.8 | 16.8 | 6.6 | 16.1 | 6.8 | M | 28 | 5 |
| 14.4 | 7.4 | 3.4 | 8.0 | 4.0 | 8.4 | 6.6 | 8.5 | 12.6 | 6.7 | 14.1 | 7.7 | F | 19 | 11 |
| 15.3 | 7.6 | 3.2 | 7.6 | 7.0 | 7.5 | 9.2 | 7.5 | 21.0 | 7.1 | 16.4 | 6.6 | M | 45 | 1 |
| 16.9 | 7.5 | 4.5 | 7.5 | 6.8 | 7.8 | 9.4 | 7.8 | 16.6 | 8.4 | 15.8 | 8.9 | M | 43 | 2 |
| 17.5 | 8.2 | 2.5 | 8.4 | 3.7 | 8.2 | 7.8 | 9.3 | 13.3 | 8.5 | 14.4 | 7.6 | F | 20 | 9 |
| 23.7 | 7.5 | 2.4 | 8.5 | 5.4 | 7.8 | 5.8 | 7.7 | 17.1 | 8.6 | 9.8 | 7.7 | F | 57 | 3 |
| 34.9 | 7.0 | 7.1 | 7.9 | 16.9 | 7.5 | 20.4 | 7.4 | 35.8 | 8.0 | 23.9 | 8.3 | F | 28 | 12 |
| 39.2 | 7.3 | 8.2 | 7.2 | 18.4 | 7.4 | 17.0 | 8.0 | 41.6 | 7.0 | 17.5 | 7.6 | M | 40 | 6 |

Table II gives the equilibrium and recovery counts of leukocytes per ml. of oral-fluid contribution to the total lavage.

TABLE II

Equilibrium and Recovery Counts of Leucocytes per ml. of Human Oral Fluid Contribution to the Total Lavage

| Equilibrium count $\times 10^6$ | | Recovery count $\times 10^6$ | | | | | | |
|---|---|---|---|---|---|---|---|---|
| | | 10 | 20 | 40 | 60 | | | |
| 0 time | 5 min | min | min | min | min | Sex | Age | Subject # |
| 1.1 | 0.7 | 0.7 | 1.8 | 2.4 | 1.0 | F | 20 | 7 |
| 2.6 | 0.7 | 0.9 | 1.2 | 2.3 | 1.5 | F | 21 | 10 |
| 1.6 | 1.5 | 0.5 | 1.5 | 2.3 | 2.2 | F | 19 | 14 |
| 3.7 | 0.9 | 1.1 | 1.2 | 3.1 | 4.3 | M | 20 | 15 |
| 2.2 | 0.7 | 1.3 | 1.8 | 3.4 | 2.2 | F | 28 | 8 |
| 4.6 | 1.6 | 1.8 | 3.8 | 3.6 | 4.7 | F | 18 | 13 |
| 6.7 | 2.0 | 2.0 | 3.8 | 5.8 | 4.4 | F | 15 | 4 |
| 7.2 | 3.5 | 0.9 | 4.6 | 8.4 | 5.0 | M | 31 | 16 |
| 4.7 | 2.4 | 3.8 | 4.3 | 10.5 | 8.9 | M | 28 | 5 |
| 6.0 | 1.1 | 1.2 | 1.9 | 3.4 | 5.2 | F | 19 | 11 |
| 5.9 | 1.2 | 2.8 | 3.7 | 10.0 | 10.2 | M | 45 | 1 |
| 6.7 | 8.8 | 2.4 | 3.3 | 4.8 | 4.0 | M | 43 | 2 |
| 5.4 | 0.7 | 1.2 | 1.8 | 3.8 | 5.5 | F | 20 | 9 |
| 9.4 | 0.7 | 1.9 | 2.1 | 4.7 | 36 | F | 57 | 3 |
| 17.4 | 2.4 | 6.7 | 8.5 | 11.9 | 7.2 | F | 28 | 12 |
| 17.0 | 3.7 | 7.7 | 5.6 | 20.9 | 6.8 | M | 40 | 6 |

Table III shows the means, ranges and standard deviations of equilibrium and recovery leukocyte counts per total volume given in Table I.

TABLE III

Means, Ranges, and Standard Deviations of Equilibrium and Recovery Counts of Leucocytes per Total Volume of Oral Fluid Yield In Standardized Human Oral Cavity Lavages

| | Time in Minutes | | | | | |
|---|---|---|---|---|---|---|
| | 0 | 5 | 10 | 20 | 40 | 60 |
| Entity per Total Lavage | Equilibrium Count × $10^6$ | | | Recovery Counts × $10^6$ | | |
| Leucocytes | | | | | | |
| Mean | 13.7 | 3.2 | 5.2 | 7.1 | 14.6 | 11.0 |
| Range | 2.2–39.2 | 0.7–8.2 | 1.2–18.4 | 1.8–20.4 | 3.7–41.8 | 3.2–23.9 |
| Standard deviation | 10.9 | 2.0 | 5.1 | 4.9 | 10.4 | 5.9 |

Table IV shows the means, ranges and standard deviations of the equilibrium and recovery leukocyte counts per ml. given in Table II.

TABLE IV

Means, Ranges and Standard Deviations of Equilibrium and Recovery Counts per ml. of Oral Fluid Yield for Leukocytes

| | Time in Minutes | | | | | |
|---|---|---|---|---|---|---|
| | 0 | 5 | 10 | 20 | 40 | 60 |
| Entity per ml. | Equilibrium Count × $10^6$ | | | Recovery Counts × $10^6$ | | |
| Leucocytes | | | | | | |
| Mean | 6.3 | 1.6 | 2.3 | 3.1 | 63 | 4.8 |
| Range | 1.1–17.4 | 0.7–3.7 | 0.5–7.7 | 0.7–8.5 | 2.3–20.9 | 1.5–10.2 |
| Standard deviation | 4.7 | 1.0 | 2.0 | 2.0 | 4.6 | 2.4 |

Table V shows the significance of the percent differences between equilibrium and recovery counts for the leukocytes given in Table IV in accord with tests of significance of differences of the Means by the "Student T Distribution Method".

TABLE V

Significance of Percent Differences Between Equilibrium and Recovery Counts for Leucocytes

| | Recovery time in minutes | | | | | |
|---|---|---|---|---|---|---|
| Time in Minutes | 0 | 5 | 10 | 20 | 40 | 60 |
| 0 | — | .01 | .01 | .01 | NS* | .05 |
| 5 | | — | NS | .01 | .01 | .01 |
| 10 | | | — | NS | .01 | .01 |
| 20 | | | | — | .01 | .01 |
| 40 | | | | | — | .01 |

*Not Significant

EXAMPLE 2

Influence of Tobacco Smoke on Aerobic and Anaerobic Metabolism Under Acute Smoking Conditions The aerobic endogenous and (d) glucose dependent metabolism (oxygen consumption) and anaerobic (d) glucose dependent metabolism (carbon dioxide evolution) were studied using the Warburg Respirometer for more than one hundred (100) human subjects including smokers, ex-smokers and non-smokers, male and female, ranging in age from nineteen (19) to forty-eight (48) years. During the course of these experiments, the need for modifying the above standard sampling procedure was recognized in order to provide a reasonable chance of quantifying a relatively reproducible effect of tobacco smoke upon the metabolism of the oral leukocytes from subject to subject. As a result, the following procedure was adopted. Employing the information obtained from the leukocyte counts obtained in Example 1, subjects were required to rinse their mouth thoroughly with tap water two hours after eating, drinking or smoking, chewing, brushing of teeth or rinsing of the mouth. Ten (10) minutes later, the subject bathed his or her mouth with the harvesting solution while chewing a piece of paraffin for thirty (30) seconds. This conditioning zero (0) time oral fluid-cell harvest was discarded. Forty-five (45) minutes later, this procedure was repeated and a thirty (30) second oral fluid-cell harvest was collected to yield a zero (0) to forty-five (45) minute control. Forty-two or forty-three minutes later, the subject smoked a conventional standard brand filter cigarette taking twenty (20) to thirty-five (35) puffs without inhaling during the course of a three to two minute smoking period. When the smoking was completed (precisely at forty-five (45) minutes), another thirty (30) second fluid-cell harvest was taken to yield a forty-five (45) to ninety (90) minute experimental smoking sample. Forty-five minutes later, a third thirty (30) second oral fluid-cell harvest was taken to yield a ninety (90) to 135-minute recovery control. This procedure was repeated for many subjects.

Although a large number of puffs were taken in the above example, similar results were obtained from subjects following six (6) and seven (7) puffs.

The smoke obtained from puffing a single cigarette without inhaling inhibits the metabolism of oral fluid-cell harvests. Inhibitions up to and in excess of fifty (50) percent was seen for aerobic endogenous and (d) glucose dependent metabolism as measured by diminished oxygen consumption, and anaerobic glucolytic metabolism as measured by diminished carbon dioxide production. Metabolic recovery often occurred within forty five (45) minutes in non smokers, ex-smokers and in young smokers, while recovery tended to be incomplete or was strongly inhibited in older, long tern, heavy smokers (twenty (20) or more cigarettes per day and cigar smokers). The control experiments omit smoking, before collection of the second fluid-cell harvests essentially showed no differences.

EXAMPLE 3

Visualization of Acute Toxic Inhibitory Effects of Whole Tobacco Smoke and Its Gas-vapor Phase with Time-lapse Phase Contrast Cinephotomicrography of Oral Leukocytes.

Control oral fluid-cell harvests (without smoking) and harvests following smoking (Example 2) were observed by mounting a drop of the respective cell harvests contained in the oral fluid on a slide, sealing the cover slip with paraffin, and placing the slide under a phase contrast microscope. A cluster of leukocytes was sought and centered in the field as rapidly as possible. Time-lapse photography was started as soon as this was done. The entire sequence was photographed at two (2) second intervals, exposure time 0.5 second. Showing the resulting film at sixteen (16) frames per second yielded an impression of events forty (40) times faster than they occur as viewed by the observer through the microscope.

For any given control (without smoking) oral fluid-cell harvest, many of the leukocytes, either free or of a given cluster, locomote vigorously, while demonstrating protoplasmic flow characterized by pseudopodia formation, cell extension, cell stretching and movement of organelles internally. Frequently, leukocytes phagocytize large rod, chain, and filamentous or other oral microorganisms. The overall effect is often quite dramatic.

In contrast, leukocytes of any given oral fluid-cell harvest, sampled immediately after any subject takes between seven (7) to thirty (30) puffs without inhaling during a two (2) to three (3) minute period from over-the-counter cigarettes, filtered or unfiltered without or with a Cambridge CM113A filter, often appear on the brink of locomotion or phagocytosis, but almost every cell remains incapable of overcoming locomotion and phagocytosis inhibitor effects of the toxic substances contained in the gas-vapor phase of tobacco smoke. Most of the leukocytes of such clusters appeared to be "frozen" or immobilized and remained so throughout the observation period. At times, leukocytes at the periphery and within some of the clusters round and their granules exhibit active Brownian motion of a "troubled" leukocyte. On rare occasions, leukocytes locomote very sluggishly while exhibiting vesicle formation, bubble blowing or blebbing and attempt feeble phagocytosis without success.

The foregoing examples establish unequivocally the adverse effect of whole tobacco smoke or the gas-vapor phase of tobacco smoke upon oral leukocytes.

The following examples illustrate how these adverse effects are obviated by means of the novel filters of this invention.

EXAMPLE 4

Reversal of Acute Toxicity of the Gas-Vapor Phase by a Strongly Basic Anion Exchange Resin The procedures described in Example 2 were repeated, employing in conjunction with the "Cambridge CM113A" filter, a filter bed about one inch to one and a half (1½) inches in length comprising an "Amberlite IRA-900" strongly basic anion exchange resin. The smoke was caused to pass through both filters before entering the mouth. The oral fluid-cell harvests collected in the same manner immediately after smoking contained healthy, viable, actively locomoting and phagocytizing leukocytes behaving in the same healthy functional manner as the control (no smoking) harvests described previously.

EXAMPLE 5

Reversal of Acute Toxicity of the Gas-vapor Phase by the Bicarbonate Form of a Strongly Basic Anion Exchange Resin Example 4 was repeated, substituting as the anion exchange resin, one prepared by passing a bicarbonate solution comprising six (6) grams of sodium bicarbonate in 300 ml. of highly purified glass distilled water through a one (1) inch to one and one half (1½) inch "Amberlite IRA-401" resin bed at a rate of about one (1) ml. (twenty (20) drops) per minute, followed by thorough washing with 500 ml. of highly purified glass distilled water. The results obtained were identical to those found in Example 4.

EXAMPLE 6

Reversal of Acute Toxicity of the Gas-vapor Phase by Strongly Acidic Cation Exchange Resins Example 4 was repeated, substituting a filter bed of "Dowex 50", a strongly acidic cation exchange resin about one (1) inch to one and one half (1½) inches in length. The results obtained were the same as in Example 4.

EXAMPLE 7

Reversal of Acute Toxicity of the Gas-Vapor Phase by a Combination of Strongly Basic Anion Exchange Resin and Strongly Acidic Cation Exchange Resin Example 4 was repeated, substituting equal lengths of a combined bicarbonate form of the strongly basic anion exchange resin and a strongly acidic cation exchange resin to yield a filter about one (1) inch to one and one half (1½) inches in length. The results were the same as in Example 5.

EXAMPLE 8

Reversal of Acute Toxicity of Whole Tobacco Smoke

The procedures described in Examples 4, 5, 6, and 7 were repeated, except that the "Cambridge CM 113 A" filter was eliminated. The results were substantially the same, indicating that the ion exchange resin beds may be used alone, and need not be employed in conjunction with other filtering means, (e.g., currently used filters for removing tars and nicotine), in order to obviate the effect of tobacco smoke upon the ubiquitous leukocytes.

EXAMPLE 9

Reversal of Acute Toxicity of the Gas-vapor Phase and Whole Tobacco Smoke by a Three Quarters (¾) Inch Long Filter System The procedures employed in Examples 4 and 8 were repeated using a combination of the bicarbonate form of the strongly basic anion exchange resin, the strongly acidic cation exchange resin and activated carbon, a known adsorbent of cyanide and carbon monoxide. One-quarter inch lengths of each of the components were used to yield a three quarters (¾) inch long filter. The result was the same as in Example 4 providing evidence for the shortest filter that reverses the adverse effects of the toxic substances contained in the gas-vapor phase of the tobacco smoke.

A properly constructed tobacco filter device system consisting of strongly basic anion exchange resins or strongly acidic cation exchange resins alone or in combination with and without activated carbon purges toxic substances contained in the gas-vapor phase of cigarette (tobacco) smoke and substantially reduces the tar and nicotine of the particulate fraction contained in primary direct main-stream smoke taken into the human resulting in reduced health risk to the smoker. It follows that such filter assist devices purge the secondary direct main-stream smoke exhaled into the environment by the human smoker resulting in reduced air contamination of noxious substances inhaled by smokers, ex-smokers and non-smokers leading to reduced health risk to all.

EXAMPLE 10

Human Oral Cavity Biomarker Assays Used for in vitro Analysis of Toxic Substances in the Gas-vapor Phase of Tobacco Smoke Once the above deleterious acute effects upon the metabolism and function of human oral neutrophils in vivo by whole tobacco smoke and its gas-vapor phase had been established, an in vitro investigation of some likely components in the gas-vapor phase that induced these undesirable effects was undertaken.

Zero (0) to (45) forty five-minute control oral fluid-cell harvests collected from human subjects as in Example 2 were used. Five substances tested in their pure form were acrolein, cyanide, acetaldehyde, nitrogen dioxide and nitric oxide. Other components in tobacco smoke also can be studied readily.

Two of the substances, acrolein and cyanide, exhibited effects comparable to those obtained after in vivo exposure of the human subject oral cavities to six (6) to ten (10) puffs from an average standard brand filtered or unfiltered cigarette with and without a Cambridge CM113A filter. Acrolein induced forty-eight (48) percent inhibition and sixty-six (66) percent inhibition of aerobic endogenous metabolism at final concentration levels of $1\times10^{-6}$ Molar to $2.5\times10^{-6}$ Molar inhibiting aerobic (d) glucose dependent metabolism, in turn, at these same concentration levels by forty-nine (49) percent and eighty-one (81) percent. Anaerobic glucose metabolism was inhibited eighteen (18) percent and forty-three (43) percent, respectively, at final concentration levels of $1\times10^{-5}$ Molar to $2.5\times10^{-5}$ Molar. The peripheral inflammatory cells progressively showed impaired to virtual total loss of function over acrolein final concentrations ranging from $1\times10^{-6}$ Molar to $7.5\times10^{-6}$ Molar. In summary, acrolein markedly inhibits metabolism and peripheral inflammatory cell function of oral fluid-cell harvests at lower concentrations of this substance than the reported levels contained in one puff of smoke from any standard brand name cigarette.

Cyanide produced similar interference with the metabolism and peripheral inflammatory cell function of oral fluid-cell harvests; the concentration range of cyanide required being somewhat larger in amounts than acrolein to inhibit metabolism, cell locomotion and phagocytosis.

Cyanide also induced these effects at lower concentrations than the reported levels contained in one puff of smoke from any standard name brand cigarettes. $5.5\times10^{-5}$ Molar sodium cyanide produce about eighty (80) percent loss of peripheral inflammatory cell function, while $5.5\times10^{-5}$ to $5.5\times10^{-4}$ Molar concentrations of cyanide inhibit aerobic metabolism by fifty (50) percent to one hundred (100) percent.

These human bioassay and biochemical assay criteria are very sensitive and meaningful biomarker indicators of the undesirable nature of acrolein and cyanide in tobacco smoke compared to other assay criteria currently available and/or in use.

Acetaldehyde produced twenty-five (25) percent to sixty (60) percent inhibitions of oral fluid-cell harvest aerobic (d) glucose dependent metabolism at final concentration levels of $1\times10^{-4}$ Molar and $1\times10^{-3}$ Molar. The same concentrations of acetaldehyde produced ten (10) percent to thirty (30) percent inhibitions of anaerobic glucolysis.

Nitrogen dioxide in a nitrogen carrier bubbled through oral fluid-cell harvests at concentration levels of 2,000 gamma/ml. produces variable and, at times, doubtful inhibitions of aerobic metabolism, while the subjective impression was that the same treatment enhanced peripheral inflammatory cell function.

Nitrogen oxide in a nitrogen carrier bubbled through oral fluid-cell harvests at concentration levels of 3,000 gamma/ml. did not influence metabolism or cell function.

These essential human bioassay and biochemical criteria detect the adverse effects of three of the most highly undesirable substances acrolein, cyanide and acetaldehyde in the gas-vapor phase of tobacco smoke. Obviously, these in vitro assay criteria can be used as biomarkers to monitor changes or modifications of tobacco and/or its products, which are designed or intended to eliminate from tobacco, smoke harmful substances and their concomitant deleterious effects. The above procedures are not intended to be limited to acrolein cyanide and acetaldehyde, but by way of illustration, can serve as a biomarker screen for the detection, monitoring and measurement of other noxious substances, known or unknown, present in tobacco smoke.

EXAMPLE 11

Human Oral Fluid-cell Harvest Biomarker Assays and Moisture Content of Ion Exchange Resin Filters Result in Priming Reading to a Systematic Health Hazard Reduction (HHR) Scale In the above examples, ion exchange resins in the form of beads incorporated into the effective filter assist devices were prepared in a manner to be optimally moist. For example, when either form of ion exchange resin beads were washed with pure glass distilled water or were altered (as in the case of the bicarbonate form of the strongly basic anion exchange resin), the beads were used sufficiently moist to cling together when spread on a sheet of filter paper to remove excess water. Such filter assist devices consistently are effective in eliminating the undesirable effects as measured by the bioassay and biochemical assays and remain effective for up to twenty (20) cigarettes, the most that were smoked and tested using single filters. Such filter assist devices are ideal for: 1) multiple use or reuse unitized disposable filter system cigarette or cigar holders; 2) multiple use or reuse filter cartridge inserts for customized cigarette and cigar holders and for pipes; and 3) for filter systems designed for air conditioners and other air ventilating systems.

Appropriately moist multiple use or reuse filter assist devices, whether unitized or as a cartridge insert are easily protected by moisture-proof packaging until used. To adapt such an appropriately moist filter system to a conventional over-the-counter cigarette, however, requires a moisture-proof barrier around the filter bed to prevent excessive moisture contamination of the tobacco bed Both ends of the moisture-proof barrier would have to be composed of a material strong enough to resist the forces exerted by manufacturing and packaging, yet for example, brittle enough to be broken by pinching prior to smoking.

Obviously, these filter assist devices are effective for removing the toxic substances contained in the tobacco smoke of any over-the-counter conventional cigarette. Although a suitably moist filter assist device is effective for one to twenty cigarettes for multiple use or reuse filter systems designed as smoking aids and although such suitably moist systems are effective when tied to a conventional over-the-counter cigarette, for practical purposes associated with packaging, shelf life and cost of manufacture, the moisture content of the ion exchange resin could be excessive.

Ideally for one time or single use ion exchange filter assist devices tied directly to a smoking charge, the moisture content contained in the filter should be compatible with the moisture content of the tobacco charge. To test this matter, dry ion exchange resin filter systems as described heretofore were studied with variable results. The larger the filter system column for some of the materials, the better was the result. Generally speaking, smoking a cigarette six (6) to ten (10) puffs through dry resin ion exchange filter systems one (1) inch to one and one quarter (1¼) inch in length gave variable results, usually showing impairment of leukocyte function. Adding some moisture up to an optimal amount showed improvement of filter efficiency. Examination of the dry filters on a puff by puff basis show that the ion-exchange resin filters accumulate some of the particulate phase of the tobacco smoke becoming darker and darker, thus, removing sequentially greater and greater portions of the tar and nicotine, while gradually becoming moister from water in the tobacco bed demonstrating that moisture accumulation also occurred.

Optimal moisture is a major key to achieve priming. The instantaneous accumulation of some tar and nicotine, whether selectively removed by the ion exchange resins or simply removed by the barrier nature of the ion exchange resins, enhance the priming effect. Regardless of the cationic or anionic interaction capacity of the ionic exchange resins, the presence of moisture, tar and nicotine further permit the selective removal of highly reactive and appropriately polar (and for that matter, non-polar) substances, toxic, and non-toxic. The ion exchange resins (including activated carbon), moisture, and initial tar and nicotine, possibly because of their affinity for compounds in the gas-vapor phase of tobacco smoke, or vice versa, and probably because of the barrier effect and of polymerization of compounds both polar and non-polar in the aggregate: 1) enable new free polar groups (regardless of charge) and non-polar groups to be exposed and available; 2) permit removal of more and more toxic substances by adsorption; and 3) result in accelerated interaction and polymerization. Regardless of the anionic or cationic nature of the ion exchange resins, both strongly ion exchange resin types, alone or in combination, without or with small amounts of activated carbon prove equally effective with respect to the removal of toxic compounds from tobacco smoke and become more effective, puff after puff.

It is apparent that smoking one cigarette (e.g., taking ten (10) puffs on one cigarette) results in adverse effects when using the ion-exchange resin filters in their dry form, since one puff of a tobacco product contains sufficient toxic substances in the tobacco smoke to adversely effect these essential bioassay and biochemical assay biomarkers. It is further apparent that at least one or more, puffs are required to condense enough water from the tobacco charge in the filter assist device to prime dry ion exchange resins with sufficient moisture to become effective. The gradual accumulation of tar and nicotine by direct absorption, adsorption, occlusion, blockage or interaction with or by the ion exchange resins further enhances the priming of the ion exchange resin making a still more effective filter. This filter not only removes some tar and some of its contained undesirable substances and the nicotine, but also toxic substances in the gas-vapor phase which may have a chemical affinity for the tar and nicotine.

The toxic effect of noxious substances of smoke from tobacco, or for that matter any other smoking material, can therefore be titrated one puff at a time through the above or any filter assist devices using the above assay techniques providing sequential information puff after puff. In this manner, a systematic health hazard reduction (HHR) scale for toxic substances in whole smoke or the gas-vapor phase of tobacco smoke is realized.

Based on an average number of ten (10) puffs per cigarette, an HHR rating of zero (0) or zero (0) percent would mean that cumulatively all ten (10) puffs adversely affect these assay systems. An HHR rating of five (5) or fifty (50) percent would mean that the first five (5) puffs cumulatively adversely affect these assay systems-five (5) do not. An HHR rating of two (2) or eighty (80) percent would mean that the first two (2) puffs cumulatively adversely affect these assay systems—eight (8) do not. An HHR rating of ten (10) or one hundred (100) percent would mean that no puffs adversely affect these assay systems.

Since the HHR rating is a biological measure of potential health hazard reduction, further refinement of the HHR rating for any smoking product is realized by determining the response of groups of human subjects. The response of the HHR rating for any of the aforementioned examples can be determined in cohort groups of five (5) or more smokers, and/or five (5) or more ex-smokers and live (5) or more non-smokers. If the HHR ratings are the same for each category, then the HHR ratings as exemplified above are applicable for all humans. If the HHR ratings differ for one (1) or more cohort category, then differing HHR ratings are realized accordingly. Furthermore, because of the biological variation between individuals, the HHR ratings as cited above might yield a range scale as for example, an eighty (80) percent HHR rating may prove to be a mean value of HHR ratings ranging between sixty (60) percent to ninety (90) percent.

An HHR rating for tar and nicotine can also be determined since tar and nicotine are removed by these filter assist devices. Direct analysis of the concentrations of tar and nicotine can readily be determined. Reduction of tar in the particulate matter of tobacco smoke reduces known carcinogenic substances contained therein. The use of specific ion-exchange resins (and activated carbon) that can eliminate known (and as yet to be demonstrated unknown) toxic substances in the gas-vapor phase also may selectively remove carcinogenic substances from the gas-vapor phase.

In addition, the associated reduction of nicotine by these filter assist devices would aid in reducing nicotine dependence as a habit-inducing agent for continued smoking. This will enable tobacco smokers who wish to stop to wean themselves away from their smoking habit more readily by choice at any point in time.

EXAMPLE 12

Taste and Aroma

The taste of the gas-vapor phase that enters the mouth is acrid and unpleasant when a conventional over-the-counter cigarette is smoked through a Cambridge Filter. When activated carbon filter assist devices are tested, one (1) inch length filter beds are required to yield effective reversal of the aforementioned adverse toxicity effects. When a cigarette is smoked through such effective activated carbon filter assist devices, the matter that enters the mouth, like the gas-vapor phase, is not smoke and is not taste or aroma acceptable. Based on a continuing survey of the many human subjects who participated, the tobacco smoke obtained from over-the-counter cigarettes smoked through these strongly cationic or anionic filter assist devices or their combination with one quarter (¼) inch lengths of carbon is much less irritating without compromising taste and aroma of the tobacco smoke. In the instance of untreated or simply water washed strongly basic anion exchange resins taste and aroma is affected undesirably because of the release of residual ammonia.

As noted above, the effective filter assist devices can be used for as many as twenty (20) cigarettes. However, because of taste one multiple use or reuse unitized disposable filter assist holder or multiple use or reuse disposable filter assist cartridge insert for a customized holder or pipe should be used more sparingly. No more than five (5) cigarettes should be used with any of the multiple use or reuse systems. The response of individual like or dislike of taste will dictate the variance of usage, more or less, by each smoker. The ultimate dislike of taste undoubtedly results from excessive accumulation of the entire spectrum of noxious substances from the gas-vapor phase, tar, nicotine and moisture in the filter systems. Some moisture from the mouth in the form of oral fluids also enters the filter system from the mouthpiece as a result of smoking an excess number of tobacco charges.

EXAMPLE 13

Extension of Biomarker Assay Criteria to a New Myeloperoxidase Assay

The above detection and measurements of the broad metabolic parameters of oral fluid-cell harvests and their contained functional polymorphonuclear neutrophils (PMN) and probably other leukocytes which led to the reduction and/or elimination of toxins from whole tobacco smoke were extended by studying various enzyme systems in oral fluid-cell harvests, e, g, Eichel, et al. (1965) and Niukian et al. (1973), in a series of experiments to develop other sensitive human in vivo and in vitro assay criteria. One major result of this work clearly indicated that a critical enzyme associated with the function of the neutrophil is present in oral fluid-cell harvests. As data accumulated, it became more and more probable that this enzyme was myeloperoxidase, the bacterial kill and toxin-detoxifying enzyme of the neutrophil.

Agner (1941,1943) first prepared a highly purified myeloperoxidase (verdoperoxidase) from empyematous fluid of human tuberculous patients, leucocytes of a patient with myeloic leukemia and chloro-leucemic infiltrates. In 1958, Ehrenberg and Agner crystallized the enzyme from cells isolated from pus obtained from dog uteri. The enzyme's activity was inhibited by cyanide, azide, fluoride and hydroxylamine (Agner 1941,1958). The addition of equimolar amounts of hydrogen peroxide to a solution of myeloperoxidase immediately and irreversibly inactivated the enzyme. Only when the hydrogen peroxide was slowly and continuously added to the enzyme solution could the stoichiometry of the reactions be studied (See Paul, 1960). Agner (1941) estimated that the peroxidase of myelocytes (polymorphonuclear leucocytes-neutrophils) constitute one (1) percent to two (2) percent of the total dry weight as determined by point by point measurements employing a recording microspectrograph. Schwartz and Thorell (1956) with similar techniques localized the enzyme in the granular zone of the myelocyte. Schultz and Kaminker (1962) established that mycloperoxidase is a lysosomal enzyme being concentrated in the primary granules of the polymorphonuclear neutrophils and constitutes up to five (5) percent of the dry weight of neutrophils. Harrison and Schultz (1976) demonstrated that myeloperoxidase is the only mammalian peroxidase able to peroxidize chloride by hydrogen peroxide to produce the potent oxidant and bacterial kill compound, namely hypochlorous acid. Many other reports concerning myeloperoxidase appear in scientific journals and literature.

Eichel (1961) and Eichel and Lisanti (1964) favored the idea that the bulk of the metabolism in human whole saliva is host cell, probably leukocyte (myclocyte) in origin, rather than microbial. Eichel and Shahrik (1969) observed and demonstrated by direct microscopy that oral leukocytes are in a highly functional state, when harvested from the human mouth under appropriate protective conditions. Protected fluid-cell harvests or lavages from human oral cavities (Eichel and Shahrik, 1969) and human sputum from chronic bronchitics, Chodosh et al. (1961) (1973), contain large numbers of intact leukocytes of the myelocyte type, mainly the polymorphonuclear neutrophil. Specifically, human oral fluid-cell harvests or lavages collected with chewing paraffin are a combination of secretions from the salivary glands and mucosal glands along with the gingival sulcus exudate (the source of the myelocytes). The microscopically identifiable components include the myelocytes (mostly neutrophils) sloughed epithelial cells, granular masses, microbial forms, intact organelles from fragmented leukocytes, and their soluble or solubilized contents. Specifically, human sputum from chronic bronchitics may be regarded as a mucopurulent secretion or exudate containing a broad spectrum of cells, consisting mainly of neutrophils, macrophages, monocytes, bronchial epithelial cells, and in those cases, where there is an asthmatic component, mast cells and eosinophils. Sputum is readily and repetitively available from most patients with chronic obstructive pulmonary diseases. Leukocytes contained in sputum specimens have not been obtained in a physiologically observable functional state. The collection of human oral fluid-cell lavages and human sputum are non-invasive techniques. Specimens for study are obtained from volunteer donors with minor guidance.

Lisanti and Eichel (1963) reported that the diorthoquinone nordihydroguaiaretic acid (nordihydroguaiaretic acid from the William J. Stange Co., Chicago, Ill.) a well-known antioxidant and at the time, food and drug additive used to extend shelf life of foods, candies and drugs, was an effective experimental anti-caries agent in hamsters in vivo. Burk and Woods (1963) referring to unpublished experiments of Eichel and Lisanti in which the latter demonstrated that low concentrations of nordihydroguaiaretic acid markedly inhibited the aerobic and anaerobic glycolysis, and nearly as effectively inhibited endogenous and glucose dependent respiration of non-protected paraffin stimulated human whole saliva, also showed that nordihydroguaiaretic acid similarly inhibited the same metabolic activities in Ehrlich carcinoma, Li210 mouse leukemia and other cancer cells in vivo and in vitro.

Burk and Woods (1963) correlated many of their observations with others of Eichel and Lisanti and explored these inhibition effects in some depth pinpointing nicotinamide-adenine dinucleotide, reduced nicotinamide-adenine dinucleotide ratios as the probable mechanism of action for the glycolytic inhibitions, the availability of nicotinamide-adenine dinucleotide being required at a value or level sufficient to permit cellular activity of glyceraldehyde-3-phosphate dehydrogenase. Burk and Woods referred to other unpublished observations of Eichel who found that nordihydroguaiaretic acid, at the concentration levels which produced marked inhibitions in the above studies, rapidly accelerated the oxidation of a chewing paraffin stimulated human whole saliva supernatant enzyme system in the absence of protective harvesting media and in the presence of substrate amounts of reduced nicotinamide-adenine dinucleotide normally employed in spectrophotometric analyses for reduced nicotinamide-adenine dinucleotide dependent enzyme systems. Further characterization of the reduced nicotinamide-adenine dinucleotide-nordihydroguaiaretic acid-human whole saliva interaction demonstrated that at least two enzymes or enzyme systems were present and participated in this activity, a weakly reactive probable reduced nicotinamide-adenine dinucleotide oxidase and a highly reactive reduced nicotinamide-adenine dinucleotide-nordihydroguaiaretic acid myeloperoxidase. An active reduced nicotinamide-adenine dinucleotide phosphate-nordihydroguaiaretic acid system also was found.

In contrast to the above nordihydroguaiaretic acid effect upon myeloperoxidase, Tappel and Marr (1954) showed that $2.7\times10^{-4}$ Molar (80 ppm) nordihydroguaiaretic acid produced seventy-one (71) percent inhibition of turnip peroxidase, fifty-six (56) percent inhibition of liver catalase (like myeloperoxidase, both heme enzymes) and seventy-one (71) percent inhibition of yeast alcohol dehydrogenase; while $2.7\times10^{-3}$ Molar nordihydroguaiaretic acid (160 ppm) produced one hundred (100) percent inhibition of squash ascorbic acid oxidase (a copper enzyme), ninety-three (93) percent inhibition of rat liver cyclophorase, ninety-nine (99) percent inhibition of pig heart D-amino acid oxidase, (a flavoprotein), seventy (70) percent inhibition of rat liver cyclophorase, and ninety-nine (99) percent inhibition of jack bean urease. Nordihydroguaiaretic acid also is a well-known inhibitor of plant lipoxidase-catalyzed oxidation and autooxidation of linoleate, Tappel et al. (1953). In still other experiments, Eichel (unpublished) found that nordihydroguaiaretic acid is an effective inhibitor of the respiratory chain including both succinic oxidase and reduced nicotinamide-adenine dinucleotide oxidase of mouse heart homogenates under certain conditions. The respiratory chain includes the cytochromes and cytochrome oxidase (known heme enzymes).

These varied actions of nordihydroguaiaretic acid as a potent antioxidant which exhibits many enzyme and metabolic inhibitor effects, serves to emphasize its unique role as a mediator or activator of any enzyme or metabolic activity, e.g. a reduced nicotinamide-adenine dinucleotide-nordihydroguaiaretic acid-myeloperoxidase system.

The following results given for the characterization and quantification of myeloperoxidase activities in the presence of reduced nicotinamide-adenine dinucleotide are similar for non-protected stimulated human saliva, protected human oral-fluid cell harvest homogenates and supernatant extracts, for human sputum cell homogenates and supernatant extracts. The data indicate that these preparations contain a sluggish reduced nicotinamide-adenine dinucleotide oxidase and an active reduced nicotinamide-adenine dinucleotide-nordihydroguaiaretic acid (semi-quinone form) mediated myeloperoxidase, which act independently.

Aliquots of fresh human oral fluid-cell harvests as exemplified above or fresh human sputum collected by the donors over a twenty-four (24) hour period were disrupted employing either Ten Broeck glass homogenizers or the Virtis homogenizer. Homogenates were centrifuged at 1,300×g for ten (10) minutes and the supernatant extracts were kept during the course of analysis at zero degrees centigrade (0° C.). Other reactants were incubated at thirty-five degrees centigrade (35° C.). Reduced nicotinamide-adenine dinucleotide oxidase and norhydroguaiaretic acid-myeloperoxidase activities were followed at 340 mμ or (nm) employing the Beckman Model DU Spectrophotometer temperature regulated at thirty-five degrees centigrade (35° C.). All specific reactions were run as duplicate assays.

Nordihydroguaiaretic acid; beta, gamma-dimethyl-alpha, ortho-bis (3,4 dihydroxiphenyl) butane or 4,4'-(2,3 dimethyl butane) dipyrocatechol is a diorthoquinone type polyphenol possessing the following structural formula:

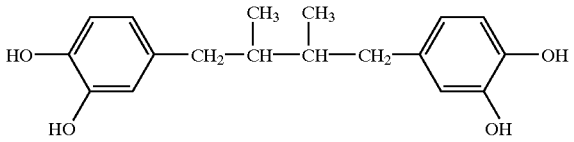

The molecular weight of nordihydroguaiaretic acid is 302.26 with a melting point of 184° to 185° C. It is soluble in ethanol, methanol, ether, acetone, glycerol, propylene glycol, dilute alkali (developing pink to deep red color with time); slightly soluble in hot water and chloroform; and insoluble in dilute hydrochloric acid. It occurs in nature, a preferred source being the desert evergreen Creosote Bush (*Larrea divaricata*), commonly found in the southwestern part of the United States. The plant's leaves prepared as a boiled tea has a history in the folk medicine of the Native Americans of Clark County, Nev. as a medicinal cure-all. It was synthesized from hydroguaiaretic acid ether and its structure determined in 1918 by Schroeter et al.).

Oxidation of reduced nicotinamide-adenine dinucleotide by nordihydroguaiaretic acid in the presence of $PO_4$ buffer at pH 7.0 occurs at a slow rate, (See Burk and Woods (1963) and references to findings of Eichel, B. and Lisanti, V. F. reported therein). Although this oxidation was very small under the conditions of experiment, an interaction correction factor was determined and applied to all reduced nicotinamide-adenine dinucleotide-nordihydroguaiaretic acid-mycloperoxidase assay reactions.

The velocity constants for the myeloperoxidase reactions behaved and were computed in accord with zero order reaction kinetics. The sluggish oxidase activities are highly variable, seldomly behaving in accord with zero order reaction kinetics for a reasonable time interval, for example two minutes. In most instances, the activities followed first order reaction kinetics for a short interval and then ceased abruptly. The latter may be due to the presence or accumulation of variable concentrations of an unidentified inhibitor or inhibitors in the supernatants. Since in all cases the oxidase activities were very slow relative to the myeloperoxidase activities, the difference in optical density over the course of the reactions (up to ten (10) minutes) for the oxidase system were computed in the same manner as the data for the rapid myeloperoxidase system. Thus, all velocity constants were expressed in $\mu$ Moles of reduced nicotinamide-adenine dinucleotide oxidized per minute per ml. of oral fluid-cell harvest or sputum. The small oxidase activities were applied as a correction factor in the computation of all myeloperoxidase velocity constants.

TABLE VI

The effect of Aging Nordihydroguaiaretic Acid (NDGA) Solutions upon the Interaction Between Reduced Nicotinamide-Adenine Dinucleotide ($NADH_2$) and Nordihydroguaiaretic Acid (NDGA)

| Age of NDGA* Solution in | Rate of Oxidation of $NADH_2$ In Optical Density (O.D.) Units per 100 Seconds** | | |
|---|---|---|---|
| Minutes | Experiment 1 | Experiment 2 | Experiment 3 |
| 10 | | | .017 |
| 15 | | .020 | |
| 45 | .027 | | |
| 60 | | | .013 |
| 110 | .011 | | |
| 120 | | | .011 |
| 140 | | .014 | |
| 175 | .012 | | |
| 180 | | | .012 |
| 215 | | .014 | |
| 240 | | | .012 |
| 270 | .011 | | |
| 285 | | .014 | |
| 323 | .011 | | |
| 380 | | | .011 |
| 440 | | | .011 |
| 485 | | | .010 |

The sequence of addition and concentration of reactants are as follows: 1.8 ml. glass distilled water, 1.0 ml. of the NDGA solution*, 0.2 mg. of $NADH_2$ in 0.2 ml. glass distilled water. Total reaction volume = 3.0 ml.
*10 mg of NDGA was dissolved in 0.4 ml of ethyl alcohol plus 19.6 ml of 0.15 M $Na2HPO_4.KH_2PO_4$ buffer, pH 7.0. The NDGA solution was incubated at 35° C. during the course of experiment.
**One O.D. unit is defined here as a 0.001 optical density change.

The effect of aging nordihydroguaiaretic acid solutions (0.5 mg. nordihydroguaiaretic acid dissolved in 0.02 ml. of ethyl alcohol plus 0.98 ml. of 0.15 Molar $Na_2HPO_4.KH_2PO_4$ buffer, pH 7.0) on the oxidation of reduced nicotinamide-adenine dinucleotide by nordihydroguaiaretic acid is shown above in Table VI. At 35° C., the latter undergoes a slow visible auto-oxidation change, from a near colorless solution (the reduced form of the orthoquinone) immediately after preparation, to a yellow brown colloidal suspension (probably the quinone form) with the yellow-brown material tending to precipitate slowly during the course of several hours. The sedimentation of nordihydroguaiaretic acid and its accumulation and adherence upon the inner glass surface of test tubes was avoided by shaking the solution periodically. The slow oxidation of reduced nicotinamide-adenine dinucleotide by nordihydroguaiaretic acid during the first forty-five (45) minutes can be more than twice the rate of subsequent time periods. Once the lowest rate of oxidation of reduced nicotinamide-adenine dinucleotide is achieved by the aging of nordihydroguaiaretic acid solutions, it remains constant for at least eight (8) hours. These results indicate that while the insoluble yellow-brown quinone accumulates, small amounts of a soluble semi-quinone form (pink color) are available for interaction with the reduced nicotinamide-adenine dinucleotide.

When the interaction at 35° Centigrade between reduced nicotinamide-adenine dinucleotide and the freshly prepared nordihydroguaiaretic acid reagent solution was subtracted from the myeloperoxidase interaction at zero time, the resultant velocity constant was zero. Myeloperoxidase activity progressively increased to higher and higher levels (a six (6) fold increase from one (1) to eight (8) hours) as more as illustrated in Table VII below, more and more of the nordihydroguaiaretic acid was converted to the soluble pink semiquinone and insoluble yellow brown (quinone) forms. Such a finding denotes that small concentrations of hydrogen peroxide are sourced from the auto oxidation of nordihydroguaiaretic acid, probably accumulate and are available for interaction with the soluble pink semiquinone form of nordihydroguaiaretic acid, the reduced nicotinamide-adenine dinucleotide and myeloperoxidase approaching the complete intact system. Increasing, but small hydrogen peroxide concentrations probably limit and in effect, control the continuously increasing myeloperoxidase activity. Despite the constant low level of auto-oxidation between reduced nicotinamide-adenine dinucleotide and nordihydroguaiaretic acid solutions during the one (1) and eight (8) hour period, hydrogen peroxide is accumulating and approaching critical optimal levels for activity. The latter circumstance appears to be analogous to the slow continuous addition of hydrogen peroxide to mycloperoxidase solutions reported previously to determine the stoichiometry of such reactions.

TABLE VII

The Effect of Aging Nordihydroguaiaretic Acid (NDGA) Solutions upon Reduced Nicotinamide-Adenine Dinucleotide ($NADH_2$)-Nordihydroguaiaretic Acid (NDGA)-Myeloperoxidase (MPO) Velocity Constants

| Age of NDGA* Solutions in Minutes | $NADH_2$-NDGA-MPO** |
|---|---|
| 0 | 0.00 |
| 60 | 8.97 |
| 120 | 14.43 |
| 180 | 27.65 |
| 240 | 28.89 |
| 337 | 32.40 |
| 397 | 41.39 |
| 440 | 44.21 |
| 485 | 46.85 |

*See footnote Table 1** $\mu$ Moles $NADH_2$ oxidized per minute per ml. of sputum supernatant The pH optimum of the myeloperoxidase system was determined. When fresh nordihydroguaiaretic acid solutions were prepared and interaction rates with reduced nicotinamide-adenine dinucleotide were subtracted as controls from oral lavage and sputum supernatant myeloperoxidase activities, the net velocity constants were zero (0). On the other hand, five (5) hour old nordihydroguaiaretic acid solutions yielded optimal activities at approximately pH 7.4. Subsequent experiments uniformly were carried out at pH 7.0 using five (5) hour old solutions to minimize the rates of the auto oxidation of nordihydroguaiaretic acid and oxidation of reduced nicotinamide-adenine dinucleotide by nordihydroguaiaretic acid when employing alkaline pH's.

Figure 7:
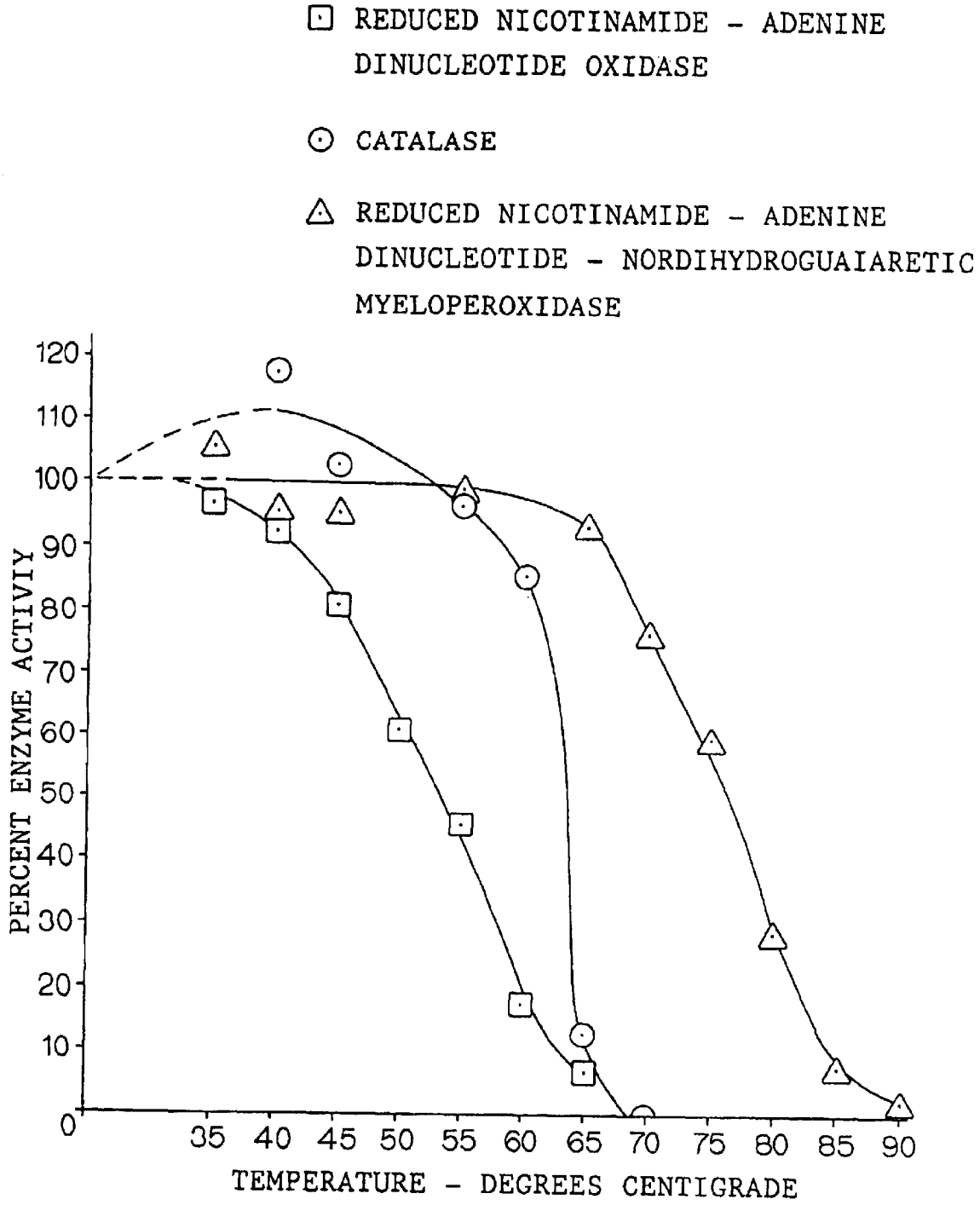
FIG. 7 shows a graph of the influence of temperature on enzyme activities.

The effect of exposure to increasing temperature for a period of ten (10) minutes upon the enzyme systems of the supernatants was also determined (FIG. 7). Reduced nicotinamide-adenine dinucleotide oxidase exhibits optimal activities at thirty-five (35) degrees Centigrade to forty (40) degrees centigrade being progressively inhibited with almost complete loss of activity at sixty (60) degrees centigrade to sixty-five (65) degrees centigrade. Myeloperoxidase characteristically yields continuously high specific activity until sixty (60) degrees centigrade to sixty-five (65) degrees centigrade and is then progressively inhibited with almost complete loss of activity between eighty-five (85) to ninety (90) degrees centigrade. The differing inactivation response to temperature clearly differentiates the presence of the two enzyme systems in these preparations. Catalase activity also was studied in these experiments and clearly shows a third response to temperature inactivation.

In another study, the oxidase and myeloperoxidase systems activities were determined for sputum supernatant extracts from twenty (20) human volunteer subjects as illustrated in Table VIII below. In each instance, the nordihydroguaiaretic acid solutions were aged for exactly five hours prior to the enzyme assays. A broad range of activities was obtained; with a seventeen (17) fold difference apparent for the oxidase system compared to a fifty-seven (57) fold difference for the myeloperoxidase system. In every case, the myeloperoxidase velocity constants were far higher than were those for the oxidase. Based on the mean values obtained, the supernatant extract specific mycloperoxidase activities were 143 times higher than their respective specific oxidase activities.

TABLE VIII

Reduced Nicotinamide-Adenine Dinucleotide ($NADH_2$) Oxidase and Reduced Nicotinamide-Adenine Dinucleotide ($NADH_2$) Nordihydroguaiaretic Acid (NDGA)-Myeloperoxidase (MPO) Activities of Human Sputum

| Subject | $NADH_2$ Oxidase* | $NADH_2$-NDGA-MPO‡* |
|---|---|---|
| 1 | 0.77 | 20.36 |
| 2 | 0.231 | 24.35 |
| 3 | 0.358 | 11.80 |
| 4 | 0.083 | 11.80 |
| 5 | 0.077 | 15.07 |
| 6 | 0.319 | 3.56 |
| 7 | 0.165 | 36.13 |
| 8 | 0.193 | 24.91 |
| 9 | 0.055 | 42.40 |
| 10 | 0.121 | 10.73 |
| 11 | 0.144 | 81.95 |
| 12 | 0.039 | 3.36 |
| 13 | 0.088 | 3.00 |
| 14 | 0.055 | 11.66 |
| 15 | 0.033 | 4.81 |
| 16 | 0.149 | 14.83 |
| 17 | 0.051 | 35.71 |
| 18 | 0.272 | 22.63 |
| 19 | 0.077 | 22.60 |
| 20 | 0.294 | 7.63 |
| Mean | 0.144 | 20.60 |
| Range | 0.033 to 0.358 | 3.00 to 81.95 |

*Data expressed in $\mu$ Moles of $NADH_2$ oxidized per minute per ml. of sputum
‡NDGA aged The effects of sodium cyanide, hydroxylamine, sodium azide and sodium fluoride upon the myeloperoxidase activities of supernatant extracts were also determined. Each of these reagents inhibited myeloperoxidase reactions in agreement with Agner (1941) and Ehrenberg and Agner (1958) lending confirmation to the identity of the peroxidase under study here. Each of the above inhibitors yielded differing concentration ranges over which inhibition occurred. No overlap between the cyanide concentration range and that of the other inhibitors was observed. A good deal of overlap between the hydroxylamine concentration range and the azide concentration range appeared with the hydroxylamine proving to be the more effective inhibitor. No overlap between the hydroxylamine and fluoride concentration ranges was evident. The concentrations of cyanide, hydroxylamine, azide and fluoride that produce fifty (50) percent inhibition are $3.3\times10^{-6}$ Molar, $3.3\times10^{-4}$ Molar, $1.6\times10^{-3}$ Molar and $6.3\times10^{-2}$ Molar, respectively and are depicted in Table IX shown below. The extremely high sensitivity of myeloperoxidase to cyanide is especially significant in the light of: 1) the observed effects of comparable low concentrations of cyanide upon polymorphonuclear neutrophil function and related aerobic metabolism in oral fluid-cell harvests; 2) the above concentration of cyanide is less than that in one puff of cigarette smoke; and 3) the high content of polymorphonuclear neutrophils in human oral fluid-cell harvests and human sputum of chronic bronchitics.

TABLE IX

Inhibition Of Human Sputum Reduced Nicotinamide-Adenine Dinucleotide ($NADH_2$) Nordihydroguaiaretic Acid (NDGA)-Myeloperoxidase (MPO)

| Inhibitor | $NADH_2$-NDGA-MPO Inhibitor Concentration Producing 50% Inhibition |
|---|---|
| Sodium Cyanide | $3.3 \times 10^{-6}$ M |
| Hydroxylamine | $3.3 \times 10^{-4}$ M |
| Sodium Azide | $1.6 \times 10^{-3}$ M |
| Sodium Flouride | $6.3 \times 10^{-2}$ M |

The effect of the addition of excess crystalline beef liver catalase upon myeloperoxidase activity of oral fluid-cell harvest and sputum supernatant extracts also was studied. The enzyme system is highly responsive to crystalline catalase being inhibited approximately fifty (50) percent and ninety (90) percent by fourteen (14) units and forty-one (41) units of crystalline catalase, respectively. The obvious role of catalase to metabolize, decompose and eliminate hydrogen peroxide demonstrates the participation and requirement of hydrogen peroxide in the intact reduced nicotinamide-adenine dinucleotide-nordihydroguaiaretic acid-mycloperoxidase system.

Adding excess hydrogen peroxide to the myeloperoxidase system yields a two component zero order reaction curve in the first three hundred (300) seconds. For the first thirty (30) to eighty (80) seconds of reaction, the hydrogen peroxide (from high to low concentrations) exerts little or no effect. The reaction suddenly is inhibited markedly continuing throughout the thirty to eighty (30–80) second to three hundred (300) second interval. The addition of excess hydrogen peroxide is illustrated in Table X set forth below.

TABLE X

Inhibition of Human Sputum Reduced Nicotinamide-Adenine Dinucleotide ($NADH_2$)-Nordihydroguaiaretic Acid (NDGA) Myeloperoxidase (MPO) by Hydrogen peroxide ($H_2O_2$)

| $H_2O_2$ | $NADH_2$NDGA-MPO | | | |
|---|---|---|---|---|
| $\mu$ Moles Per Cuvette | Time Interval in Seconds | % Inhibition | Time Interval in Seconds | % Inhibition |
| 177.00 | 0 to 31 | −20 | 31 to 300 | −78 |
| 59.00 | 0 to 41 | −17 | 41 to 300 | −81 |
| 29.5 | 0 to 39 | −20 | 39 to 300 | −84 |
| 19.70 | 0 to 49 | −6 | 49 to 300 | −78 |
| 9.85 | 0 to 59 | +6 | 59 to 300 | −81 |
| 5.9 | 0 to 64 | −3 | 64 to 300 | −70 |
| 2.95 | 0 to 80 | −10 | 80 to 300 | −76 |

The results obtained with the concentrations of added hydrogen peroxide employed in this study are compatible with the observation that the addition of equimolar amounts of hydrogen peroxide to a solution of myeloperoxidase quickly and irreversibly inactivates the enzyme. The slow, continuous addition of hydrogen peroxide to the enzyme solution that permits the study of the stoichiometry of the reactions (Paul 1960) indicates that the myeloperoxidase system under study here obtains hydrogen peroxide by its accumulation as an end product via the slow auto-oxidation of nordihydroguaiaretic acid. The rapid slowing of nearly all of the sluggish oxidase activities in oral fluid-cell harvests and in human sputum supernatant extracts suggests that a small accumulation of hydrogen peroxide and/or hypochlorous acid may hinder this enzyme system's activity. In either instance, the slow accumulation of hydrogen peroxide and/or the availability of non-toxic amounts of hydrogen peroxide along with the possible formation of small critical amounts of hypochlorous acid favor the complete function of the reduced nicotinamide-adenine dinucleotide-nordihydroguaiaretic acid-myeloperoxidase system. The gradual accumulation of larger and larger critical small amounts of hydrogen peroxide and possibly hypochlorous acid, approaching an optimum concentration must contribute to the constantly increasing myeloperoxidase activities observed as the reduced nordihydroguaiaretic acid solution ages while being converted to its semiquinone and insoluble quinone forms.

In the presence of added optimal concentrations of hydrogen peroxide (0.024 Molar), Niukian et al.(1973), many polymorphonuclear neutrophils in the sediment fraction of human oral lavages exhibit intense nitro-blue tetrazolium reducing enzyme activity. This hydrogen peroxide-dependent reaction in polymorphonuclear neutrophils is inhibited markedly by cyanide, azide, hydroxylamine and catalase and totally by 0.15 Molar hydrogen peroxide, indicating the participation of myeloperoxidase. In contrast, intense endogenous nitro-blue tetrazolium reducing enzyme activity in granular masses is inhibited by all concentrations of hydrogen peroxide until one hundred (100) percent inhibition is obtained at 0.15 Molar. Small numbers of polymorphonuclear neutrophils also yield intense endogenous activity that correlates with observed phagocytosis of microorganisms and the probable formation of hydrogen peroxide in the polymorphonuclear nautrophils. As the endogenous reactions in the polymorphonuclear neutrophils and granular masses is not inhibited by cyanide, azide, hydroxylamine or catalase, it is postulated that critical concentrations of endogenous bound hydrogen peroxide and peroxidase are present in these granular masses and polymorphonuclear neutrophils and are required for the endogenous activities. The exogenous hydrogen peroxide-dependent reaction in the polymorphonuclear neutrophils and endogenous reactions in the granular masses and polymorphonuclear neutrophils are inhibited completely after ten (10) minutes exposure to sixty (60) degrees centigrade and by low concentrations of iodoacetate and cupric ion. The latter indicates that the system involved in both polymorphonuclear neutrophils and granular masses consists of a complex containing one or more heat-labile and sulphhydril group-dependent components in addition to mycloperoxidase.

This myeloperoxidase system readily interacts with exogenous or externally added beef heart cytochrome c. The possibility exists that the reduced nicotinamide-adenine dinucleotide-nordihydroguaiaretic acid-myeloperoxidase system unto itself or in conjunction with the endogenous or internal cytochrome-cytochrome oxidase system may constitute a unique respiratory chain in the intact neutrophil. This system appears to have many of the properties of the oxidase-peroxidase reaction in which the reduction of cytochrome c is stimulated by horseradish peroxidase in the presence of either ascorbic acid, triose reductone or dihydroxifumaric acid on the one hand, and the interaction of a phenolic cofactor in the oxidation of reduced nicotinamide-adenine dinucleotide in the presence of horse radish peroxidase on the other hand, rendering unto nordihydroguaiaretic acid both redogenic and oxidogenic properties, respectively, in accord with Yamazaki (1958). In this case, the redogenic and oxidogenic properties would be dependent upon the availability of the reduced nordihydroguaiaretic acid in the first instance, and probably its semiquinone in the second instance. It is of interest that detoxication of diphtheria toxin occurred with oxidogenic substances (Agner, 1955; See Table X Paul 1960).

The mycloperoxidase system under consideration here should be regarded as a redogenic-oxidogenic system requiring small, critical concentrations of hydrogen peroxide and probably the semi-quinone form of nordihydroguaiaretic acid as a phenolic co-factor. This method for detecting and quantifying myeloperoxidase activity is simple and accurate over a wide range of activity.

The study of myeloperoxidase in fluid-cell harvests from the human oral cavity and human sputa introduces several unique advantages. This conclusion resides in the fact that human oral fluid-cell harvests are readily and repeatedly available from most human subjects and human sputa are readily and repeatedly available from subjects with chronic obstructive lung disease. The numbers of leukocytes, primarily polymorphonuclear neutrophils, in human fluid-cell harvests were detailed above. Sputum can be obtained from chronic obstructive lung disease human subjects in substantial amounts, and contain essentially very large numbers of polymorphonuclear leukocytes, mostly neutrophils, macrophages or histiocytes, some eosinophils and mast cells (in association with an allergic component) and bronchial epithelial cells depending upon the nature of the disease and its state. It should be noted, however, that only very small quantities of sputum, oral fluid-cell harvests, whole salivas or oral exudates are required for analysis. Sputum polymorphonuclear leucocyte to macrophage and bronchial epithelial cell ratios ranging roughly between seven (7) to three (3) and nine (9) to one (1), have been found for patients with stable chronic obstructive lung diseases (Chodosh et al. 1961). In effect, therefore, human sputum from stable subjects with chronic obstructive lung diseases generally contain 2.3 to nine (9) times the number of polymorphonuclear leukocytes (myelocytes) than macrophages or histiocytes and bronchial epithelial cells combined. Careful selection of subjects exhibiting acute infections provides suitable sputum specimens in quantity that exhibit very high neutrophil numbers and high neutrophil to combined eosinophil, macrophage and bronchial epithelial cell ratios. Such cases yield substantial to very high myeloperoxidase activities. The fortuitous fact that myeloperoxidase occurs in the polymorphonuclear neutrophil, obviates to a marked extent that sputum specimens contain other inflammatory and bronchial epithelial cells. Myeloperoxidase is not present in macrophages, mast cells or bronchial epithelial cell. Possible contributions of myeloperoxidase from any source other than neutrophils is mitigated by studying sputum from patients with chronic bronchitis, since chronic bronchitic sputa contain large numbers of neutrophils and sparse numbers of cells associated with allergy.

EXAMPLE 15

Application of Biomarker Assay Criteria to Human Long Term Health Status Research The detection, measurement and reversal of acute toxicity effects of whole tobacco smoke and its gas-vapor phase employing the human oral cavity and the utilization of fluid-cell harvests derived from the oral cavity as a source of essential biological and biochemical biomarkers to evaluate effects of tobacco smoke is straightforward. However, the elucidation of the impact of smoking on the long-term health status and longevity of humans who smoke is complex.

The availability of filter assist devices as described herein and the means for proving their effectiveness at the human level for the simultaneous in vivo reduction of noxious compounds in the gas-vapor phase, tar and nicotine of any tobacco smoke product opens a systematic approach to long term prospective studies of human population cohorts. A way to achieve this goal can be realized by long term, prospective investigation of population cohorts who use tobacco smoking products made with the filter assist devices of this invention compared to cohorts who use conventional tobacco products that in turn are compared to cohorts of ex-smokers and non-smokers as control groups.

Specific biomarker studies of human oral fluid-cell harvests or oral fluids or oral cells relating to chronic usage of tobacco smoke products, although few in number, do exist and have been highlighted in a review by Cagna and Princi (1998) dealing with "Cigarette Smoking as a Risk Factor of Periodontal Disease". Human oral biomarkers, such as those herein used to define acute adverse effects of noxious substances in tobacco smoke and the reversal of these effects by appropriate tobacco smoke assist filter systems, remain to be explored in relation to the chronic usage of tobacco smoke products. Long term, prospective study of human periodontal disease and oral cancer employing the reduced toxic substance smoking products proposed herein as opposed to conventional smoking products can provide useful models and information in regard to health status by comparing cohort groups for each type of smoker product to ex-smoker and non-smoker cohorts.

Specimens of sputa from long term smokers compared to ex-smoker and non-smoker cohorts with chronic obstructive lung disease, mainly chronic bronchitics, also provide a useful model for long term, prospective studies to track the effects and impact of tobacco smoke on this major human health problem and possible longevity.

Human sputum contains a broad spectrum of cellular and biochemical indicators which are useful for the objective evaluation of the nature, severity and extent of the various chronic bronchial disorders. This mucoid exudate reflects the underlying inflammatory state of involved bronchial tissues. Reticuloendothelial system cells and bronchial epithelial cells in twenty-four hour sputum collections have been studied as diagnostic criteria (Chodosh and Medici 1971; Medici and Chodosh 1972).

Attention also has focused upon specific enzymes present in human sputum exudates as diagnostic indicators or criteria for assessing the status of patients with chronic bronchial diseases. Eichel, et al. (1972) partially characterized L(+) lactate dehydrogenase activities of twenty-four (24) hour sputum collections and concluded as with the enzyme in fluid-cell samples from the human oral cavity that the sources of the enzyme are essentially host cells and not microorganisms. Bürgi et al. (1968) related a range of L(+) lactate dehydrogenase activities and isozymes to the inflammatory state in chronic bronchitic early morning sputum specimens. Chodosh et al. (1973), confirmed the findings of Bürgi et al. (1968) for twenty-four hour sputum collections in chronic bronchitic patients during acute bacterial exacerbations and recovery phases. Levine et al. (1969) reported L(+) lactate dehydrogenase isozyme data from the sputa of patients with a variety of bronchopulmonary disorders primarily relating their observations to severity of illness. Eichel et al. (unpublished) studied the histochemical localization and semiquantititation of reduced nicotinamide-adenine dinucleotide, reductase (diaphorase) and reduced nicotinamide-adenine dinucleotide phosphate reductase activities in polymorphonuclear neutrophils, macrophages (histiocytes) and bronchial epithelial cells of twenty four (24) hour sputum collections from a variety of chronic bronchial diseased patients.

The results given here deal with the quantitative analysis of L(+) lactate dehydrogenase, myeloperoxidase and catalase enzyme activities in twenty-four (24) hour human sputum specimens from chronic bronchitics. The data demonstrate that these specific enzyme activities can serve as discriminators between stable state versus acute bacterial exacerbations and for the first time between cigarette smoker versus ex-smoker human chronic bronchitics.

Sputum is readily and repetitively available from most chronic bronchitic patients. In each case, the subjects brought a twenty-four (24) hour sputum collection to the laboratory. One gram aliquots of the sputum specimens were selected and homogenates prepared with glass distilled water in Ten Broeck glass homogenizes in accord with Eichel et al. (1972). In this work, aliquots of the homogenate were assayed directly for the respective enzyme activities. The homogenate dilution and size of the aliquot generally was predetermined by trial assay.

L(+) lactate dehydrogenase was assayed in accord with Eichel et. al. (1972).

The new spectrophotometric assay method, developed for mycloperoxidase, was employed in accord with that given in Example 14.

Catalase activities were followed at 240 mμ or nm. employing a slight modification of the spectrophotometric method of Beers and Sizer (1952) and that used by Eichel and Swanson (1957) for tissue homogenates. The concentration of reactants and their sequence of addition into cuvettes were as follows: 1.9 ml. of glass distilled water, 1.0 ml. of 0.05 Molar reagent grade hydrogen peroxide in 0.15 Molar potassium dihydrogen phosphate.sodium monohydrogen phosphate, pH 7.0 (to yield 0.700 optical density in a final reaction volume of 3.0 ml. using distilled water in place of homogenates); and 0.1 ml. of sputum homogenate—the dilution of the latter being dependent upon the velocity of the reaction encountered.

All assays were performed in duplicate and the data reported are averages. The velocity constants for the (L+) lactate dehydrogenase, mycloperoxidase and catalase activities behaved and were computed in accord with zero order reaction kinetics. (Reaction rates were measured in umoles of either reduced nicotinamide-adenine dinucleotide per minute per ml. of sputum (for (L+) lactate dehydrogenase and mycloperoxidase) or hydrogen peroxide decomposed per minute per ml. of sputum for catalase.

Figure 8:
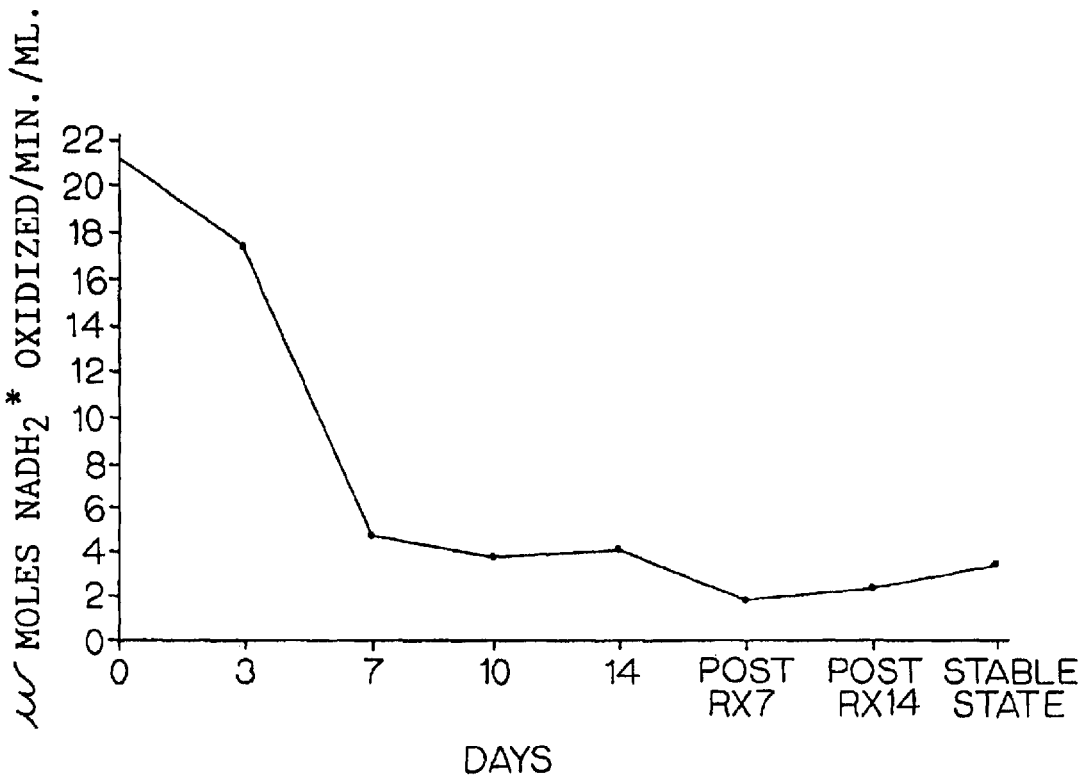
FIG. 8 shows a graph of a chronic bronchitic smoker yielded sputum (L+) lactate dehydrogenase activity.

By example, one sixty-six (66) year old male chronic bronchitic smoker yielded sputum (L+) lactate dehydrogenase activity (FIG. 8) from the onset of an acute bacterial exacerbation throughout fourteen (14) days of therapy during fourteen (14) days of post-therapy and finally the enzyme level detectable in the sputum when the chronic bronchitic condition has once again achieved the steady inflammatory stable state at least thirty (30) days post-therapy. The pattern of high enzyme activity at the onset of acute Bacterial exacerbation, decreasing rapidly by day seven (7) during therapy and maintaining a low constant level throughout the remaining therapy and post-therapy periods to the stable state is characteristic of the individual who responds favorably to the acute bacterial insult. In general, this sequence of events applied to a larger group of subjects (Chodosh et al., 1973). This response also has been seen for mycloperoxidase and catalase activities.

Figure 9:
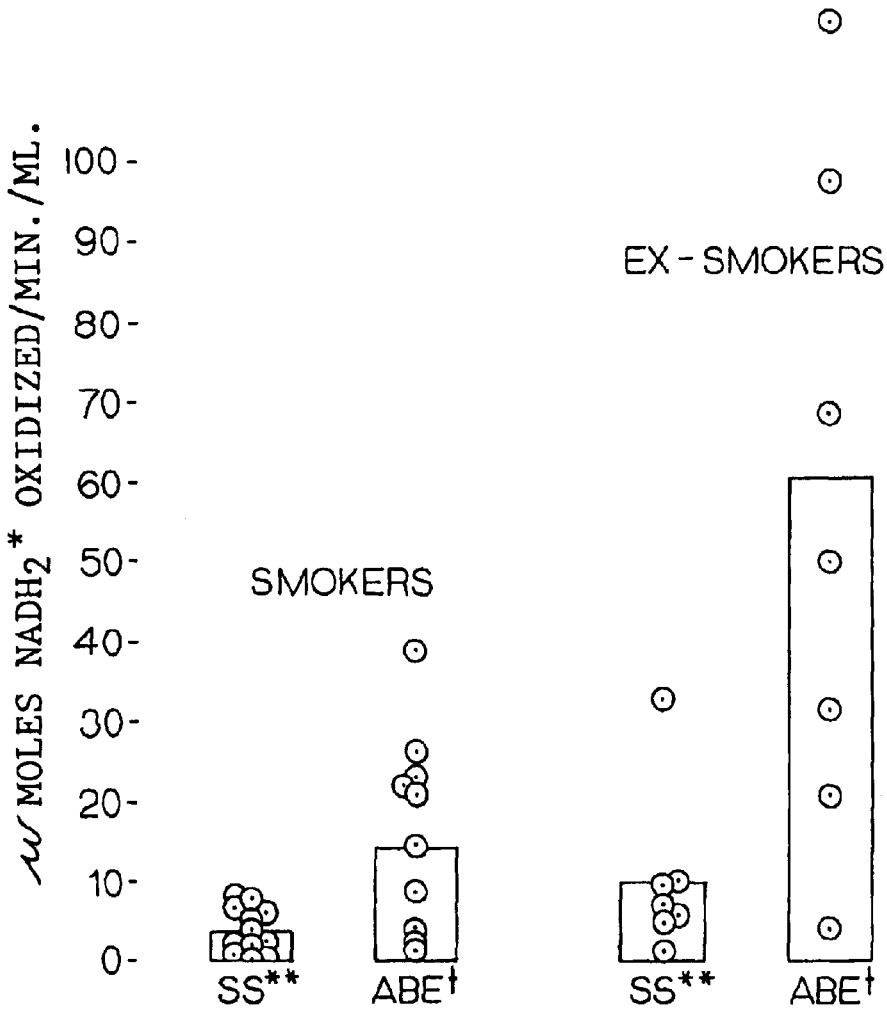
FIG. 9 shows a scattergram of individual sputum L(+) lactate dehydrogenase activity for groups of chromic bronchitics.

(L+) lactate dehydrogenase activities were determined in homogenates of twenty-four (24) hour sputum collections provided by nineteen (19) chronic bronchitic, twelve (12) cigarette smokers and seven (7) ex-smokers. The individual and mean specific sputum (L+) lactate dehydrogenase activities obtained for the steady inflammatory stable state (obtained either at least thirty (30) days prior to an acute bacterial exacerbation or thirty (30) days post-therapy following an acute bacterial exacerbation) and for the acute bacterial exacerbation inflammatory state are given in the scattergram as shown in FIG. 9. The mean (L+) lactate dehydrogenase activities and standard deviations for each group were computed and set forth below in TABLE XI. The sputum (L+) lactate dehydrogenase activities clearly were lower for the steady stable state compared to those found for the acute bacterial exacerbation state in both cigarette smoker and ex-cigarette smoker groups. Using the Student T Test, the groups were significantly different at p less than 0.05. Conversely, when the sputum (L+) lactate dehydrogenase activities were compared between the cigarette smoker and ex-cigarette smoker groups, the cigarette smoker stable state and acute bacterial exacerbation state clearly yielded lower activities than the ex-cigarette smoker group. Statistical analysis showed that the cigarette smoker acute bacterial exacerbation state enzyme activities versus the ex-cigarette smoker acute bacterial exacerbation were significantly different at p less than 0.05.

TABLE XI

SPUTUM (L+) LACTATE DEHYDROGENASE
$\mu$ moles Reduced Nicotinamide-Adenine Dinucleotide ($NADH_2$) oxidized/minute/ml

| | # Subjects | Stable State | Acute Bacterial Exacerbation | % Increase |
|---|---|---|---|---|
| Smokers | 12 | 4.0 ± 2.6* | 14.1 ± 11.4+ | 252 |
| Ex-smokers | 7 | 9.9 ± 10.4* | 59.7 ± 50.2 | 503 |
| % Increase | | 148 | 323 | |

*Stable State vs. Acute bacterial Exacerbation different at P < 0.05
+Smokers vs. Ex-smokers different at p < 0.05

The percent increase in the sputum mean (L+) lactate dehydrogenase activities comparing acute bacterial exacerbation to the stable state, and ex-cigarette smokers to cigarette smokers, respectively, assigning a value of one hundred (100) percent to the stable state and cigarette smoker mean values also were computed and are illustrated in Table XI. The acute bacterial exacerbation mean values compared to the stable state mean values were 253 percent greater for the cigarette smoker and 502 percent greater for the ex-cigarette smoker. The ex-cigarette smoker mean (L+) lactate dehydrogenase values compared to the cigarette smoker mean values were 148 percent greater for the stable state and 323 percent greater for the acute bacterial exacerbation. The high enzyme activities of the ex-cigarette smoker during acute bacterial exacerbation state are particularly noteworthy.

TABLE XII

SPUTUM MYELOPEROXIDASE
$\mu$ moles Reduced Nicotinamide-Adenine Dinueleotide ($NADH_2$) oxidized/minute/ml.

| | # Subjects | Stable State | Acute Bacterial Exacerbation | % Increase |
|---|---|---|---|---|
| Smokers | 12 | 9.6 ± 4.4*† | 29.4 ± 25.3† | 206 |
| Ex-smokers | 5 | 32.8 ± 26.3 | 197.1 ± 182.3 | 500 |
| % Increase | | 242 | 570 | |

*Stable state vs. Acute Bacterial Exacerbation different at p < 0.05.
†Smokers vs. Ex-smokers different at p < 0.05

Figure 10:
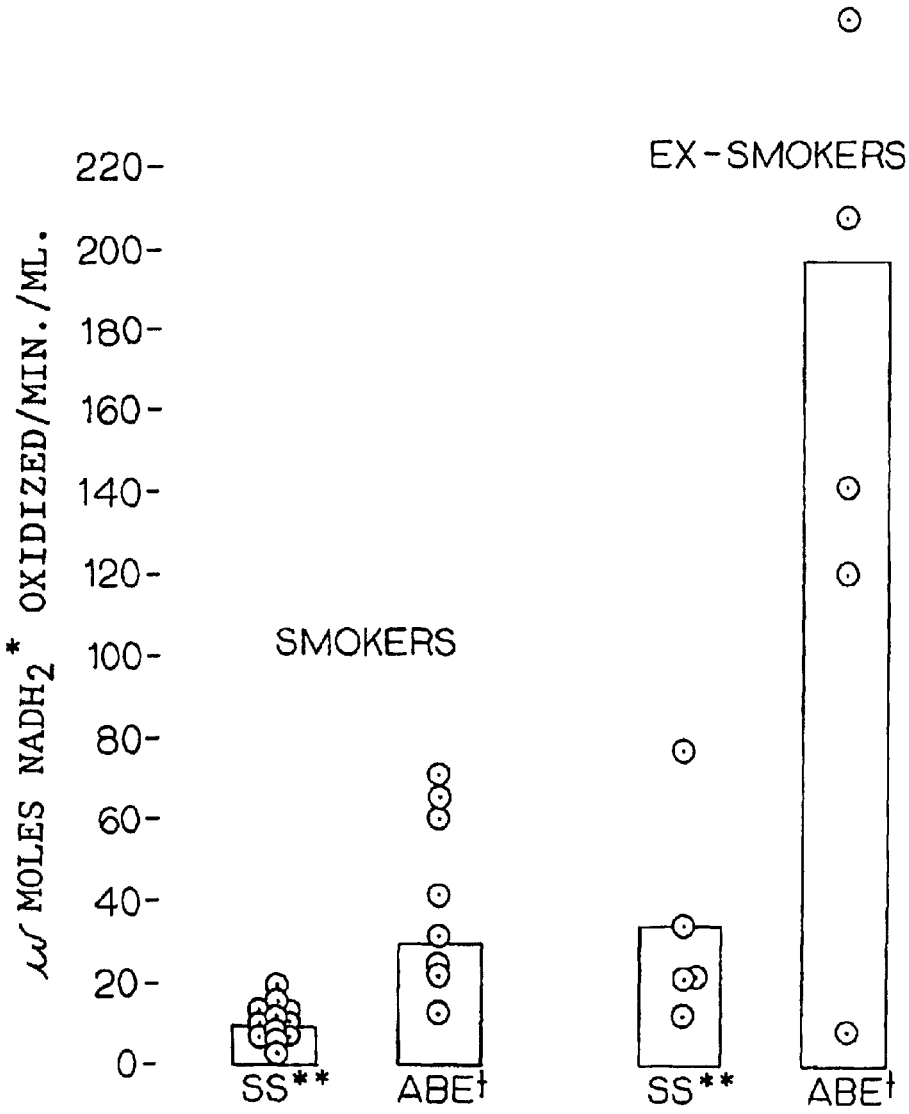
FIG. 10 shows a scattergram of individual sputum myeloperoxidase activity for groups of chronic bronchitics.
Figure 11:
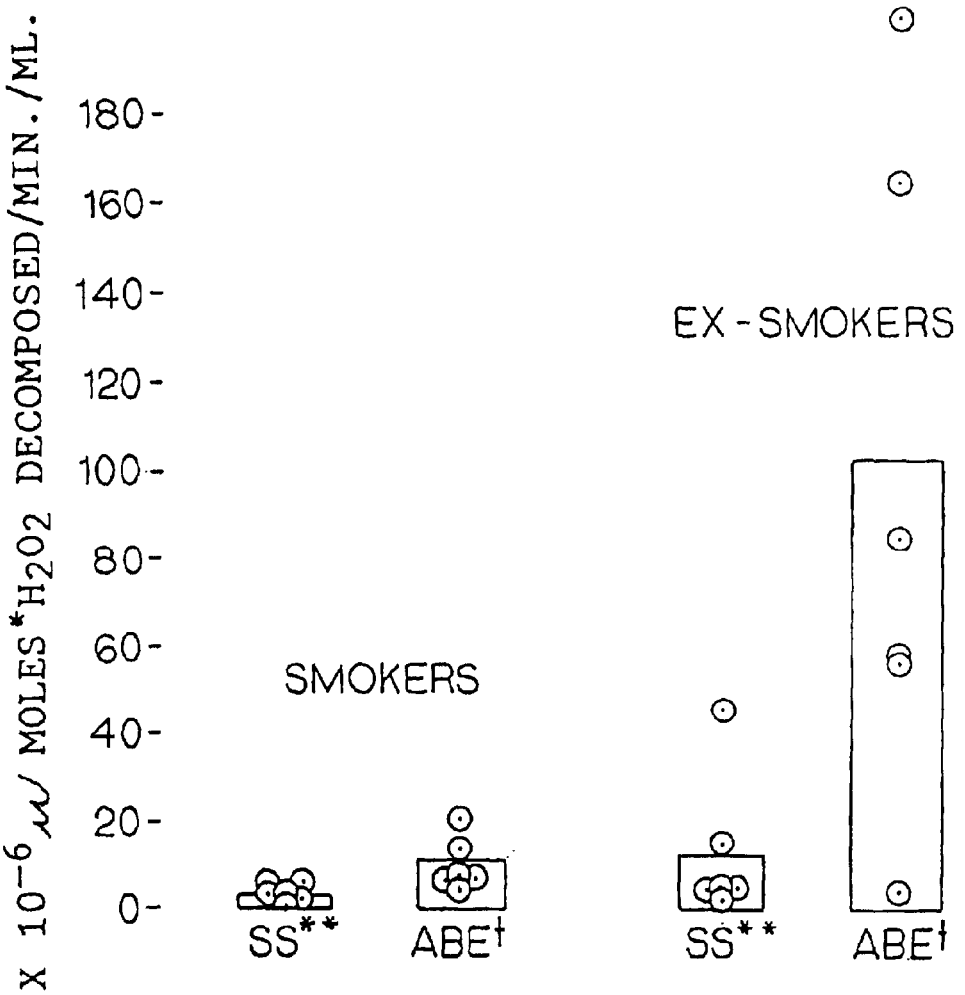
FIG. 11 shows a scattergram of individual sputum catalase activity for groups of chromic bronchitics.

Myeloperoxidase activities were determined for the sputum homogenates of twelve (12) cigarette smokers and five (5) ex-cigarette smokers as depicted in FIG. 10 and shown above in table XII above, while catalase activities were measured in six (6) cigarette smoker and six (6) ex-cigarette smokers as depicted in FIG. 11 and shown in table XIII below. The mean mycloperoxidase and catalase activities, standard deviations, significant differences employing the student T test, percent differences for acute bacterial exacerbation compared to the stable state for the cigarette smoker and ex-cigarette smoker groups and percent increases for the ex-cigarette smoker compared to the cigarette smoker for stable state and acute bacterial exacerbation groups were determined.

TABLE XIII

SPUTUM CATALASE
$\mu$ moles Hydrogen Peroxide ($H_2O_2$) decomposed/minute/ml

| | # Subjects | Stable State | Acute Bacterial Exacerbation | % Increase |
|---|---|---|---|---|
| Smokers | 6 | 273 ± 169* | 1089 ± 577† | 299 |
| Ex-Smokers | 6 | 1303 ± 1740* | 10697 ± 9501 | 721 |
| % Increase | | 377 | 882 | |

*Stable State vs. Acute Bacterial Exacerbation different p < 0.05.
†Smokers vs. Ex-Smokers different at p < 0.05.

The relationships observed for (L+) lactate dehydrogenase hold for both myeloperoxidase and catalase. One notable exception appeared for sputum myeloperoxidase where the mean specific enzyme activity for the ex-cigarette smoker stable state group compared to the ex-cigarette smoker acute bacterial exacerbation group was not significantly different at p less than 0.05 according to the Student T Test. However, comparison as well as the percent differences of the means to the companion specific (L+) lactate dehydrogenase and catalase enzyme activity data indicated that this discrepancy was caused by one mycloperoxidase value in the ex-cigarette smoker acute bacterial exacerbation group which was a typically low, thus interfering with the test of significance at the p less than 0.05 level. A second exception for mycloperoxidase was evident where the mean specific enzyme activity for the cigarette smoker stable state group compared to the ex-cigarette smoker stable state group was significantly different at p less than 0.05. Yet, here too, comparison to the analogous specific (L+) lactate dehydrogenase and catalase data and the percent differences of the means suggest that increasing the numbers of subjects in the (L+) lactate dehydrogenase ex-cigarette smoker stable state and catalase ex-cigarette smoker stable state groups would probably yield tests of significance at p less than 0.05 for the cigarette smoker stable state versus ex-cigarette smoker stable state groups.

Figure 12:
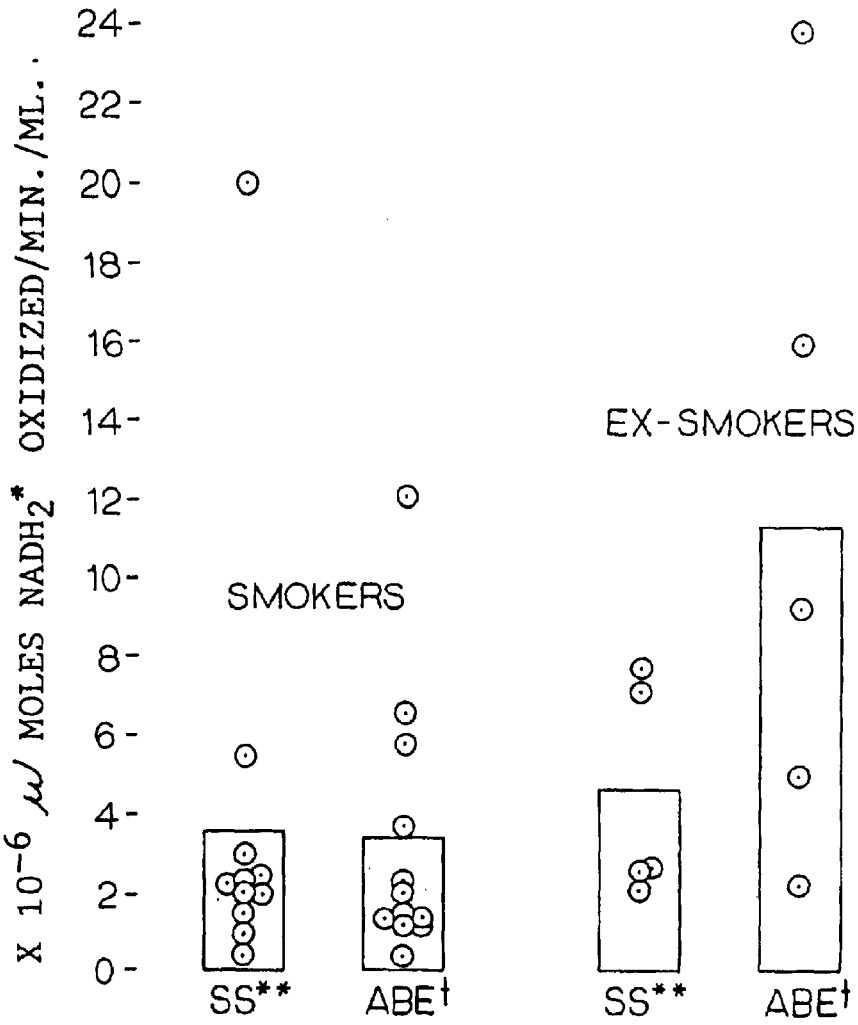
FIG. 12 shows a scattergram of individual sputum myeloperoxidase activity per polymorphonuclear neutrophil for groups of chromic bronchitics.

Since myeloperoxidase is solely localized within the polymorphonuclear neutrophil and is not found in the macrophage or histiocyte and the bronchial epithelial cell, the myeloperoxidase data were analyzed further by calculating the specific myeloperoxidase activity per polymorphonuclear neutrophil for each sputum sample as depicted in FIG. 12 and shown below in Table XIV. The results indicate that despite the one a typical low value in the mycloperoxidase ex-cigarette smoker group during the acute bacterial exacerbation inflammatory state, the latter yielded approximately 150 percent greater mean mycloperoxidase activity per polymorphonuclear neutrophil than the same group during the stable state inflammatory state. The ex-cigarette smoker group during the acute bacterial exacerbation inflammatory state yielded 250% greater mean myloperoxidase activity per polymorphonuclear neutrophil than the same state for the cigarette smoker group, being significantly different according to the Student T Test at p less than 0.02 to 0.01. Myeloperoxidase activity per polymorphonuclear neutrophil remained the same for the cigarette smoker acute bacterial exacerbation versus the cigarette smoker stable state. The latter correlation of enzyme activity for (L+) lactate dehydrogenase and catalase to specific cell types is not pertinent because these enzymes are probably in each of the three primary cell categories, although macrophages are known to be catalase rich.

TABLE XIV

SPUTUM-MYELOPEROXIDASE/POLYMORPHONUCLEAR NEUTROPHIL
$\mu$ Moles Reduced Nicotinamide Adenine Dinucleotide Oxidized × $10^6$

| | # Subjects | Stable State | Acute Bacterial Exacerbation | % Increase |
|---|---|---|---|---|
| Smokers | 12 | 3.7 ± 5.4 | 3.2 ± 3.3* | −14 |
| Ex-Smokers | 5 | 4.7 ± 2.6 | 11.4 ± 8.6 | 143 |
| % Increase | | 27 | 256 | |

*Smoker versus Ex-Smokers different at .02 < p > .01

A definition well suited to chronic bronchitic inflammation is that process initiated within the host following sublethal injury to tissue and ends either with permanent destruction of tissue or with complete healing. The latter defines inflammation as fundamental to the survival of the organism, since it functions to protect against toxic external or foreign insult and serves as the essential mechanism within the host for repair of damaged tissue. Inflammation resulting in permanent injury to tissue, however, implies that the process in some manner may become: 1) aberrant, e.g. run wild; or 2) directly defective, e.g. blocked at some critical point—either occurrence leading progressively to greater levels of tissue destruction than the original insult could produce.

Under in vivo conditions, e.g. in chronic inflammatory disease states, inflammation may be viewed as being in a steady state equilibrium which in accord with the above definition remains poised to move in either of the two directions; e.g. protection of the host, or greater harm to the host. Using the arguments of Metchnikoff (the father of host defense mechanisms and inflammation) appropriate intervention should tip the inflammatory equilibrium in the direction of protection with the ideal consequence that the sublethal tissue injury is eliminated.

A parallelism exists between the findings of Chodosh et al. (1961, 1973), Chodosh and Medici (1971), Medici and Chodosh (1972), Eichel et al. (1972), including the results given above, other unpublished studies and interpretations applied to the ongoing events of the inflammatory process in human chronic bronchitics and the evidence and views offered by Metchnikoff concerning inflammation more than a century ago. Chronic bronchitis is a non-specific inflammatory disease characterized by coughing associated with the production of variable amounts of sputum exudate. Sputum from such subjects provides a form of "biopsy" material containing a spectrum of inflammatory cells, of which the preponderance of numbers are polymorphonuclear neutrophils admixed with macrophages and monocytes, as well as exfoliated bronchial epithelial cells, all indicative of tissue damage. Sputum derives from a pathological process and, in the stable chronic bronchitic, is reflective of the underlying sublethal inflammatory steady state equilibrium associated with the ongoing chronic pathology in the bronchi. Thus, chronic bronchitic patients suffer from a sublethal tissue injury. When this sublethal tissue injury is exacerbated by the impact of acute bacterial infection or other insult e.g., smoking, the inflammatory steady state equilibrium is altered markedly. The perspective may be advanced that under the conditions of acute bacterial invasion and/or smoking the dynamics of the chronic bronchitic patient's inflammatory steady state equilibrium is such that it is forced in the direction of further harm to the host. This idea is reinforced by the symptoms, which occur indicating the greater difficulty these individuals experience in coping with the acute bacterial exacerbation. Here, too, suitable intervention where possible or the host's own defense capability can tip the dynamics of the inflammatory equilibrium in the direction of protection. The specific biochemical characteristics of polymorphonuclear neutrophils, macrophages and bronchial epithelial cells at least partially relate to the shifts of the balance between protection and harm and may account for the variable clinical course of chronic bronchitis patients.

Sputum is repetitively available over the course of the disease from the chronic bronchitic patient without resorting to invasive techniques. Twenty-four (24) hour collections avoid variations due to diurnal change. Qualitative and quantitative cytological, physiological and biochemical changes occur in the sputum polymorphonuclear neutrophils, macrophages and bronchial epithelial cells when the steady state equilibrium of the stable chronic bronchitic patient is altered by acute bacterial exacerbation and/or appropriate therapeutic intervention and/or smoking.

Based on the specific (L+) lactate dehydrogenase, myeloperoxidase and catalase velocity constants obtained in this study for sputum homogenates from chronic bronchitic cigarette smokers and ex-smokers during the steady inflammatory stable state and acute bacterial exacerbation inflammatory state, important new facts begin to emerge towards the understanding of this disease. The effect of chronic exposure of such patients to cigarette smoke can be detected by quantitative biochemical measurements of their sputum. Some of the many toxic substances contained in tobacco smoke probably alter the inflammatory cell response in chronic bronchitic cigarette smokers.

It is evident that sputum homogenate enzyme activities are greatly reduced in the steady inflammatory stable state and acute bacterial exacerbation inflammatory state of chronic bronchitic cigarette smoker compared to chronic bronchitic ex-smokers. The reduced enzyme levels in chronic bronchitic cigarette smokers can be attributed to the long-term exposure to some of the known neutrophil and metabolic inhibitors present in the gas-vapor phase of tobacco smoke. With time, effective concentrations of these inhibitors are probably sustained in the host, which maintain the characteristics of the inflammatory response in the chronic bronchitic cigarette smoker. Three of the most likely noxious substances in cigarette smoke that induce pronounced acute toxic effects on human neutrophils; namely, cyanide, acrolein and acetaldehyde (See examples above) alone and/or in combination, would inhibit each of the three enzymes studied in the sputum homogenates. The lowered enzyme activities suggest potentially lowered metabolic activities associated with the inflammatory state in the cigarette smoker patients indicating their decreased host cell capability. This, in part, may account for the increased incidence of chronic bronchitis in cigarette smokers. For example, the reduced myeloperoxidase implies that the neutrophils' bacterial kill and antibacterial toxin detoxifying capability would be less competent in the cigarette smoker. The reduced catalase implies that the macrophage, which is catalase-rich, would also be less competent. The reduced (L+) lactate dehydrogenase activity suggests interference with carbohydrate metabolism and consequently diminished neutrophil and macrophage locomotion and phagocytic function. It should be emphasized that alterations in these chronic bronchitic, cigarette smokers compared to chronic bronchitic ex-cigarette smokers were likely related to the long-term chronic exposure to tobacco smoke.

In human chronic bronchitics (Chodosh et al. 1973) the number of polymorphonuclear neutrophils, in part, reflect the level and extent of the inflammatory process. When insulted by acute bacterial infection, polymorphonuclear neutrophil numbers markedly increase over the amounts seen in the chronic bronchitic steady inflammatory stable state, suggesting that this portion of the host cell defense system is responsive.

The presence of substantial numbers of macrophages in human sputum of patients with chronic obstructive pulmonary diseases usually denotes stability, adequate reticuloendothelial system responsiveness, recovery or a minimal stage of disease (Chodosh, 1963). Observations suggest that in acute infectious exacerbations of chronic bronchitis, the macrophages in sputum exudates are reduced in number compared to those levels found in the stable inflammatory steady state (Medici and Chodosh, 1972).

Sufficient evidence has been accumulated using a number of analytic parameters of human sputa, which permits the subdivision of chronic bronchitic patients into biologically distinct groups. Some of the more useful biomarker variables are total numbers of polymorphonuclear neutrophils and macrophages, phagocytosis by neutrophils and macrophages (based on microorganisms counted in these cells), macrophage cell protoplasmic mass or volume (Eichel and Chodosh, unpublished) and (L+) lactate dehydrogenase, myeloperoxidase and catalase activities. The enzyme results show that these criteria can serve as discriminators to separate and identify chronic bronchitic cigarette smokers from chronic bronchitis ex-cigarette smokers and the chronic bronchitic steady stable state from the chronic bronchitic acute bacterial exacerbation state. These same discriminators may be of prognosticator value. They indicate that chronic bronchitic cigarette smokers and ex-cigarette smokers should be considered separately in clinical studies. They denote that the inflammatory state in the chronic bronchitic cigarette smoker is different biologically from that of the clinically similar chronic bronchitic ex-cigarette smoker.

Since the ultimate model of chronic bronchitis is man, on-going investigative research holds the promise for the development of a unified concept of the inflammatory process in this chronic disease and the manner in which tobacco smoking impacts the disease process.

While certain illustrative ion exchange resins and activated carbon have been illustrated, it will be appreciated that the invention is not limited thereto. Various types of filters, ion exchange resins and activated carbon are per se well known in the art and selection of other such resins in any chemical or physical form, activated carbon or other materials will accordingly be readily apparent to those skilled in the art in the light of the foregoing disclosure.

In like manner, since specific human biomarkers relating to tobacco smoke usage (exposure) effective dose, and potential harm also have been described, it will be appreciated further that the invention is not limited thereto. Other biomarkers that are well known in the art and selection of other such biomarkers also will accordingly be readily apparent to those skilled in the art in the light of the foregoing disclosure.

Since certain changes may be made in the above procedures and products without departing from the scope of the invention herein involved, and since other applications of the above procedures and products are envisioned, it is intended that all matter contained in the above description and in the accompanying drawings shall be interpreted as illustrative and not in a limiting sense.

The foregoing describes specific embodiments of the inventive filter and process for utilizing the filter in conjunction with bio-assays to standardize the relative safety of tobacco products. The present disclosure is not limited in scope by the illustrative embodiments described, which are intended as specific illustrations of individual aspects of the disclosure. Functionally equivalent methods and components are within the scope of the disclosure. Indeed, the instant disclosure permits various and further modifications to the preferred embodiments, which will become apparent to those skilled in the art. Such modifications are intended to fall within the scope of the appended claims.

What is claimed is:

1. A filter for tobacco products comprising:

a mixture of a strongly acidic cation exchange resin, a strongly basic anion exchange resin in bicarbonate form, a methyl cellulose material, and moisture said moisture enhancing the selective removal by said mixture of highly reactive and appropriately non-polar substances that are toxic and non-toxic.

2. The filter of claim 1 further comprising activated carbon.

3. The filter of claim 2 wherein said strongly acidic cation resin and said strongly basic anion resin and said activated carbon are separate components.

4. The filter of claim 1 wherein said strongly acidic cation exchange resin is selected from the group consisting of Dowex 50 and Dowex 50W.

5. The filter of claim 1 wherein said strongly basic anion exchange resin is selected from the group consisting of Amberlite IRA-900, Amberlite IRA 401, Dowex 1, Dowex 2, and Dowex 11.

6. The filter claim 1 further comprising a perforated polymer.

7. The filter of claim 1 wherein the ratio of filter material to tobacco ranges from 1 to 2 up to 1 to 10.

8. The filter of claim 1 wherein said tobacco filter is contained within a cartridge adapted to retain said moisture.

9. The filter of claim 8 wherein said disposable cartridge has a first male threaded end and a second male threaded end.

10. The filter of claim 9 wherein said first male threaded end and said second male threaded end engage with a first female threaded channel and a second female threaded channel respectively.

11. The filter of claim 10 wherein said male thread end is inserted into said female threaded end of a two piece pipe.

12. The filter of claim 8 wherein said disposable cartridge has a first male threaded end and a second female end.

13. The filter of claim 12 wherein said first male threaded end inserts into a female threaded channel of a cigarette holder.

14. The filter of claim 12 wherein said first male threaded end inserts into a female threaded channel of a cigar holder.

15. The filter of claim 8 wherein said disposable cartridge is used to remove harmful substances from pipe tobacco smoke.

16. The filter of claim 8 wherein said disposable cartridge is used within a cigarette holder to remove harmful substances from cigarette smoke.

17. The filter of claim 8 wherein said disposable cartridge is used with a cigar holder to remove harmful substances from cigar smoke.

18. The filter of claim 1 wherein said tobacco filter is unitized with a tobacco product.

19. The filter of claim 1 wherein said tobacco filter removes harmful components of tobacco smoke contained within a gas-vapor phase thereof.

20. The filter of claim 19 wherein said tobacco filter traps said harmful components from said gas-vapor phase and wherein said harmful components are therefore removed from a primary direct main-stream smoke and an altered secondary main-stream smoke that is exhaled into the environment.

21. The filter of claim 1 wherein said filter is unitized into a cigarette to remove harmful substances film cigarette smoke.

22. The filter of claim 1 wherein said filter is unitized into a cigar to remove harmful substances from cigar smoke.

23. The filter of claim 1 wherein said tobacco filter is unitized with a disposable cigarette holder.

24. The filter of claim 1 wherein said tobacco filter is unitized with a disposable cigar holder.

25. The filter of claim 1 wherein said tobacco filter removes harmful components of whole tobacco smoke.

26. The filter of claim 25 wherein said tobacco filter traps said harmful components front said whole tobacco smoke and wherein said harmful components are therefore removed from a primary direct main-stream smoke and an altered secondary main-stream smoke that is exhaled into the environment.

27. The filter of claim 1 wherein said tobacco filter is unitized with a disposable cigar holder.

* * * * *